US012203667B2

(12) United States Patent
Hamadate et al.

(10) Patent No.: US 12,203,667 B2
(45) Date of Patent: Jan. 21, 2025

(54) AIR CONDITIONER

(71) Applicant: DAIKIN INDUSTRIES, LTD., Osaka (JP)

(72) Inventors: Junichi Hamadate, Osaka (JP); Fumiaki Koike, Osaka (JP); Naritaka Yakura, Osaka (JP); Asahi Ono, Osaka (JP); Ayumi Kubo, Osaka (JP); Masato Okuno, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 18/374,235

(22) Filed: Sep. 28, 2023

(65) Prior Publication Data

US 2024/0019134 A1 Jan. 18, 2024

Related U.S. Application Data

(63) Continuation of application No. PCT/JP2022/015142, filed on Mar. 28, 2022.

(30) Foreign Application Priority Data

Mar. 31, 2021 (JP) ..... 2021-060340

(51) Int. Cl.
*F24F 1/30* (2011.01)
*F24F 13/20* (2006.01)

(52) U.S. Cl.
CPC ..... *F24F 1/30* (2013.01); *F24F 13/20* (2013.01); *F24F 2013/202* (2013.01)

(58) Field of Classification Search
CPC ..... F24F 1/30; F24F 13/20; F24F 2013/202; F24F 1/12; F24F 1/46; F24F 13/24
See application file for complete search history.

(56) References Cited

U.S. PATENT DOCUMENTS

2011/0219799 A1 9/2011 Park et al.
2016/0146512 A1 5/2016 Kitabatake et al.
(Continued)

FOREIGN PATENT DOCUMENTS

CN 101387427 B 12/2010
CN 109084466 A * 12/2018 ..... F24F 13/32
(Continued)

OTHER PUBLICATIONS

English translation of the International Search Report issued in corresponding International Application No. PCT/JP2022/015142, dated May 31, 2022 (3 pages).
(Continued)

*Primary Examiner* — Kun Kai Ma
(74) *Attorney, Agent, or Firm* — Osha Bergman Watanabe & Burton LLP

(57) ABSTRACT

An air conditioner includes: a casing including a bottom plate; a refrigerant flow path unit housed inside the casing, and having an interior in which a refrigerant flow path is formed; a compressor installed on the bottom plate; and a shutoff valve that opens and closes to allow and block a flow of a refrigerant. The refrigerant flow path unit is supported at a distance from the bottom plate by a fixed-side member other than the compressor. The fixed-side member includes either one of: a mounting plate to which the shutoff valve is fixed, or a support plate to which the mounting plate is fixed.

17 Claims, 19 Drawing Sheets

(56) References Cited

U.S. PATENT DOCUMENTS

| | | | |
|---|---|---|---|
| 2017/0370597 | A1 | 12/2017 | Kaneda et al. |
| 2020/0200404 | A1 | 6/2020 | Kawaguchi |

FOREIGN PATENT DOCUMENTS

| | | | | | |
|---|---|---|---|---|---|
| CN | 110319505 | A | * | 10/2019 | |
| EP | 2037187 | A2 | | 3/2009 | |
| EP | 1959204 | B1 | | 8/2011 | |
| EP | 3425292 | A1 | | 1/2019 | |
| EP | 2184549 | B1 | | 5/2019 | |
| JP | 2003148771 | A | * | 5/2003 | ..... F24F 1/12 |
| JP | 2004163072 | A | | 6/2004 | |
| JP | 3711064 | B2 | * | 10/2005 | ..... F24F 1/10 |
| JP | 2009085465 | A | | 4/2009 | |
| JP | 2010151343 | A | | 7/2010 | |
| JP | 2016084994 | A | | 5/2016 | |
| JP | 2016099083 | A | | 5/2016 | |
| JP | 2017044455 | A | * | 3/2017 | ..... F24F 1/24 |
| KR | 20070077409 | A | | 7/2007 | |
| KR | 20110083346 | A | * | 7/2011 | |
| WO | 2019097614 | A1 | | 5/2019 | |
| WO | WO-2022003869 | A1 | * | 1/2022 | |

OTHER PUBLICATIONS

Notice of Reasons for Refusal issued in corresponding Japanese Patent Application No. 2022-051655, mailed Nov. 22, 2022, with translation (8 pages).

Decision to Grant a Patent issued in corresponding Japanese Patent Application No. 2022-051655, mailed May 9, 2023, with translation (5 pages).

English translation of the International Preliminary Report on Patentability issued in corresponding International Application No. PCT/JP2022/015142, dated Oct. 12, 2023 (6 pages).

English translation of the International Preliminary Report on Patentability issued in corresponding International Application No. PCT/JP2022/015142, dated Oct. 3, 2023 (6 pages).

Extended European Search Report issued in corresponding European Patent Application No. 22780799.7 mailed Aug. 7, 2024 (7 pages).

* cited by examiner

AIR CONDITIONER

TECHNICAL FIELD

The present disclosure relates to an air conditioner.

BACKGROUND

In a known refrigeration apparatus including a refrigerant circuit for vapor compression refrigeration cycle operation, refrigerant pipes through which a refrigerant flows are combined into one in order to reduce the size of the refrigerant circuit. For example, Patent Literature 1 discloses a functional block with a refrigerant passage formed inside. The functional block is attached to a compressor.

PATENT LITERATURE

PATENT LITERATURE 1: Japanese Laid-Open Patent Publication No. 2010-151343

SUMMARY

An air conditioner according to the present disclosure includes:

a casing having a bottom plate;

a refrigerant flow path unit housed inside the casing and having an interior in which a refrigerant flow path is formed;

a compressor installed on the bottom plate; and a shutoff valve that is opened and closed to allow and block a flow of a refrigerant, wherein the refrigerant flow path unit is supported at a distance from the bottom plate by a fixed-side member other than the compressor, and the fixed-side member includes a mounting plate to which the shutoff valve is fixed, or a support plate to which the mounting plate is fixed.

DETAILED DESCRIPTION

Hereinafter, embodiments will be described with reference to the accompanying drawings.

First Embodiments

Figure 1:
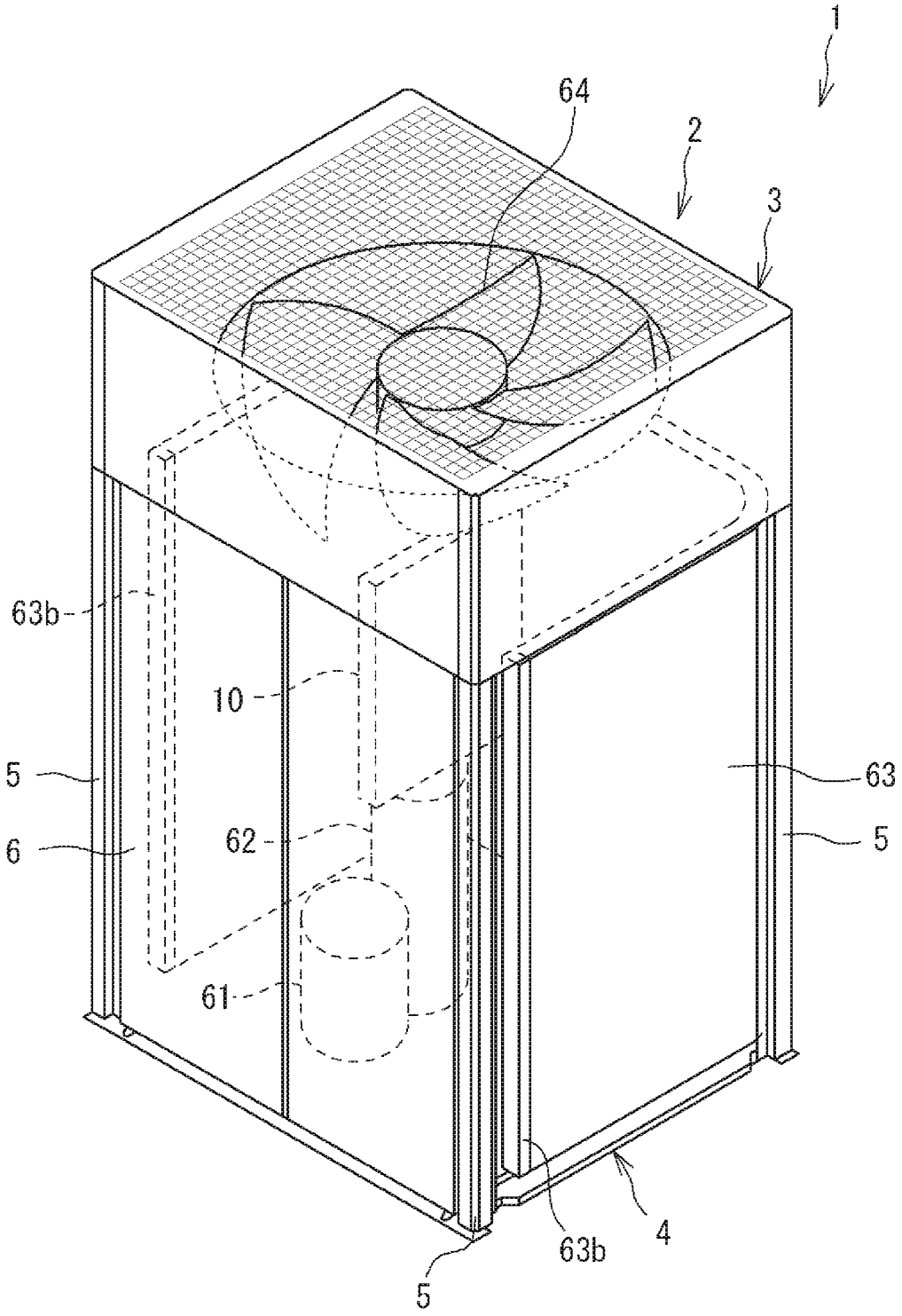
FIG. 1 is a perspective view of an air conditioner according to first embodiments of the present disclosure.

FIG. 1 is a perspective view of an air conditioner according to first embodiments of the present disclosure. The air conditioner 1 is, for example, a building-type multi-air conditioner installed in a building. The air conditioner 1 is capable of cooling and heating of a room to be air-conditioned, by a vapor compression refrigeration cycle operation. The air conditioner 1 includes an outdoor unit 2 disposed outside the room and an indoor unit disposed indoors. FIG. 1 illustrates the outdoor unit 2 of the air conditioner 1.

The outdoor unit 2 includes a casing 3. The casing 3 is formed in a rectangular parallelepiped shape and is formed in a rectangular shape in plan view. The casing 3 has a bottom plate 4, supports 5, a front panel 6, and the like. The casing 3 houses therein a refrigerant flow path unit 10, a compressor 61, an accumulator 62, a heat exchanger 63, a fan 64, a four-way switching valve 65 (see FIG. 2), an electric valve 66 (see FIG. 2), and the like. The compressor 61, the accumulator 62, and the heat exchanger 63 are installed on the upper surface of the bottom plate 4 and fixed to the upper surface. The heat exchanger 63 has a similar configuration to the heat exchanger 63 according to the second embodiments described later.

Figure 2:
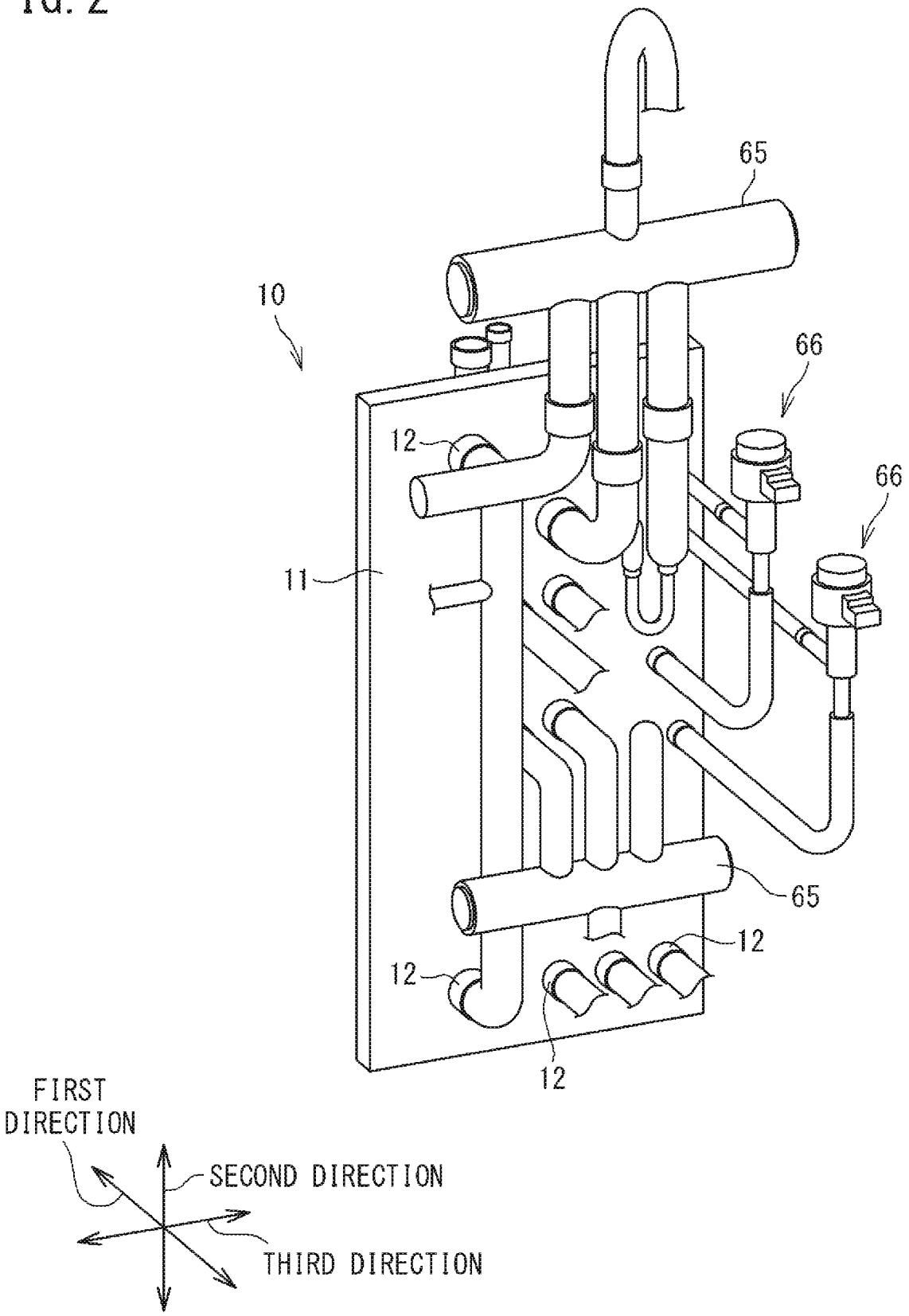
FIG. 2 is a perspective view of a refrigerant flow path unit as viewed from one side.
Figure 3:
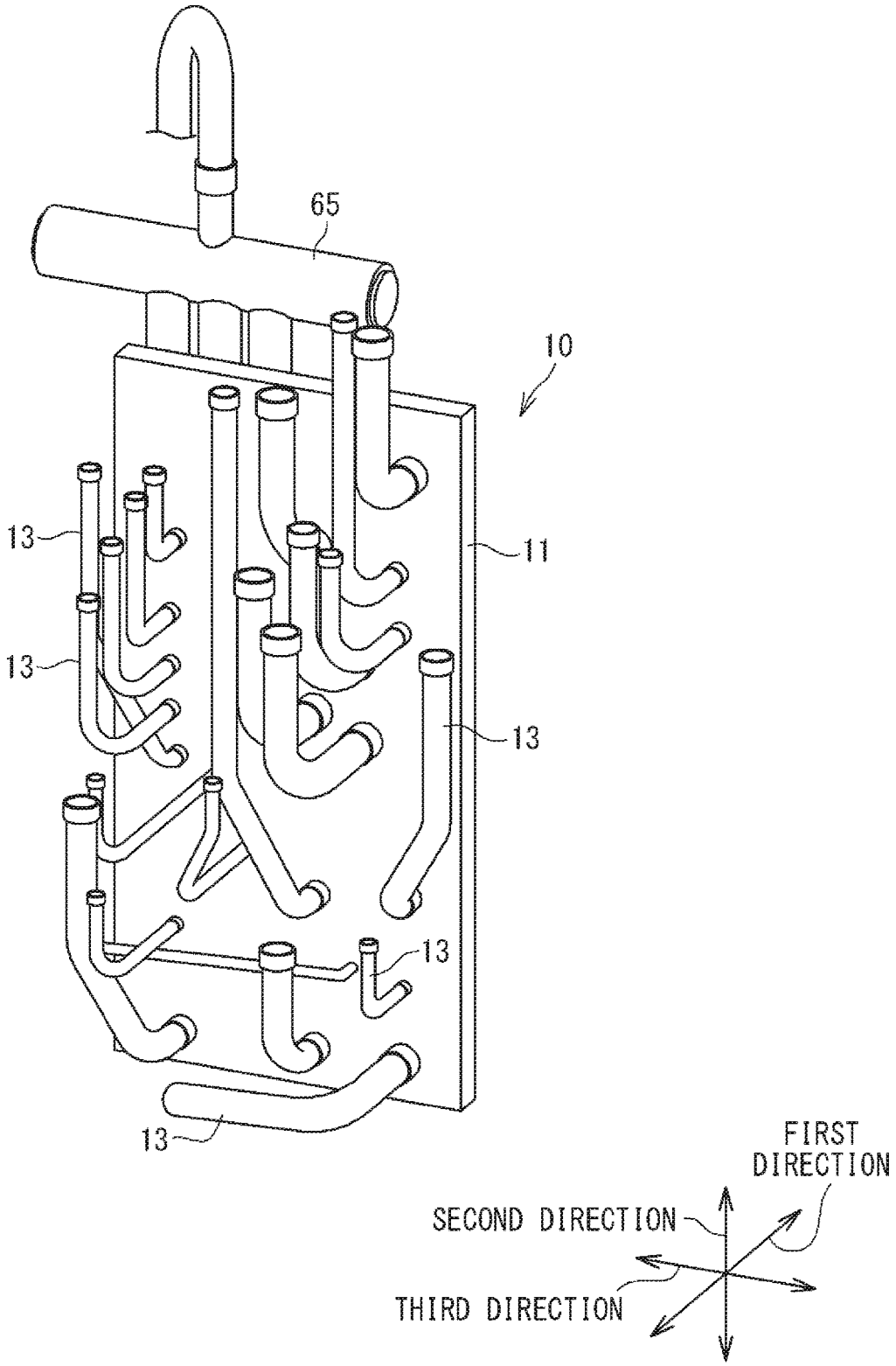
FIG. 3 is a perspective view of the refrigerant flow path unit as viewed from the other side.

FIG. 2 is a perspective view of the refrigerant flow path unit 10 as viewed from one side. FIG. 3 is a perspective view of the refrigerant flow path unit 10 as viewed from the other side. The refrigerant flow path unit 10 is connected to devices such as the compressor 61, the accumulator 62, the heat exchanger 63, the four-way switching valve 65, and the electric valve 66. For example, functional components, such as the four-way switching valve 65 and the electric valve 66, are connected to one surface of the refrigerant flow path unit 10.

Figure 4:
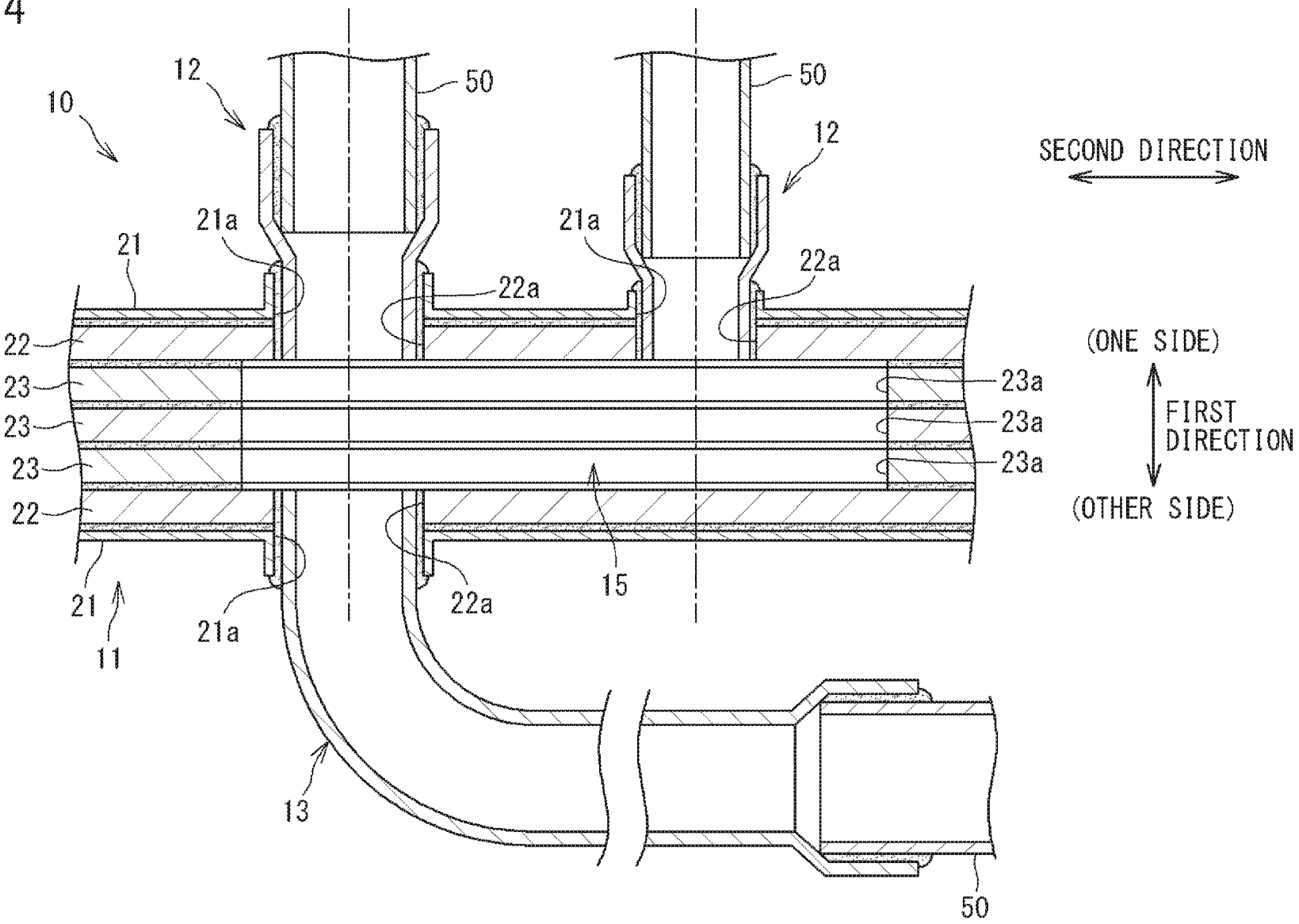
FIG. 4 is a cross-sectional view of portions of the refrigerant flow path unit.

FIG. 4 is a cross-sectional view of portions of the refrigerant flow path unit 10. The refrigerant flow path unit 10 includes a unit body 11, a first joint pipe 12, and a second joint pipe 13. The unit body 11 has a plurality of plates 21, 22, and 23. The plurality of plates 21, 22, and 23 are stacked and joined together. A refrigerant flow path 15 is formed inside the unit body 11. Hereinafter, the direction in which the plurality of plates 21, 22, and 23 are stacked is also referred to as a first direction. The direction (orthogonal to the first direction) along the plate surfaces of the plates 21, 22, and 23 is also referred to as a second direction. The direction orthogonal to the first direction and orthogonal to the second direction is also referred to as a third direction (see FIG. 2).

The plurality of plates 21, 22, and 23 has a first plate 21, a second plate 22 stacked on the first plate 21, and a third plate 23 stacked on the second plate 22. The plates 21, 22, and 23 adjacent to each other are joined by brazing.

The first plate 21 is disposed at both ends of the unit body 11 in the first direction. The first plate 21 is formed to be thinner than the other second and third plates 22 and 23. A plurality of first openings 21*a* are formed in the first plate 21. The first openings 21*a* are circular holes penetrating the first plate 21.

The second plate 22 is located second from both ends of the unit body 11 in the first direction. The second plate 22 is formed to be thicker than the first plate 21. A plurality of second openings 22*a* are formed in the second plate 22. The second openings 22*a* are circular holes penetrating the second plate 22. The second openings 22*a* each communicate with the first opening 21*a* of the first plate 21.

The third plate 23 is disposed between the two second plates 22 that are spaced apart in the first direction. In one or more embodiments, the three third plates 23 are stacked between the two second plates 22. Each of the third plates 23 is formed to have the same thickness as the second plate 22.

The third plate 23 is formed with a third opening 23*a* that constitutes the refrigerant flow path 15. The third opening 23*a* is a hole penetrating the third plate 23 or a slit extending in the second direction. In the example illustrated in FIG. 4, the third openings 23*a* are formed in the range extending across the two second openings 22*a* provided on one side in the first direction. The third opening 23*a* communicates with the second openings 22*a* of the second plates 22.

The unit body 11 of the refrigerant flow path unit 10 according to one or more embodiments is configured from the plurality of plate-shaped members (plates 21, 22, and 23), but is not limited thereto, and may be configured from members other than the plate-shaped members.

The first joint pipe 12 is attached to the first plate 21 and the second plate 22 arranged on one side (upper side in FIG. 4) in the first direction. The first joint pipe 12 is, for example, a straight joint pipe extending in the first direction. A refrigerant pipe 50 is joined to one end of the first joint pipe 12 by brazing. The refrigerant pipe 50 extends from, for example, the four-way switching valve 65 or the electric valve 66 as illustrated in FIG. 2. The other end of the first joint pipe 12 is inserted into the first opening 21*a* and the second opening 22*a*, and is joined to the first plate 21 and the second plate 22 by brazing.

The second joint pipe 13 is attached to the first plate 21 and the second plate 22 arranged on the other side (lower side in FIG. 4) in the first direction. The second joint pipe 13 is, for example, an elbow joint pipe that bends at a right angle. One end of the second joint pipe 13 is inserted into the first opening 21*a* and the second opening 22*a*, and is joined to the first plate 21 and the second plate 22 by brazing. The refrigerant pipe 50 is joined to the other end of the second joint pipe 13 by brazing. The refrigerant pipe 50 is, for example, connected to a container (the compressor 61, the accumulator 62, or the like) with a refrigerant flowing inside. The refrigerant flow path unit 10 may be configured only from the unit body 11, without the first joint pipe 12 and the second joint pipe 13. In this case, the refrigerant pipe 50 is directly connected to the unit body 11.

As illustrated in FIGS. 2 and 3, the refrigerant flow path unit 10 according to one or more embodiments is housed inside the casing 3 in a standing orientation with the plate surface (one surface) of the unit body 11 along the vertical direction.

Figure 5:
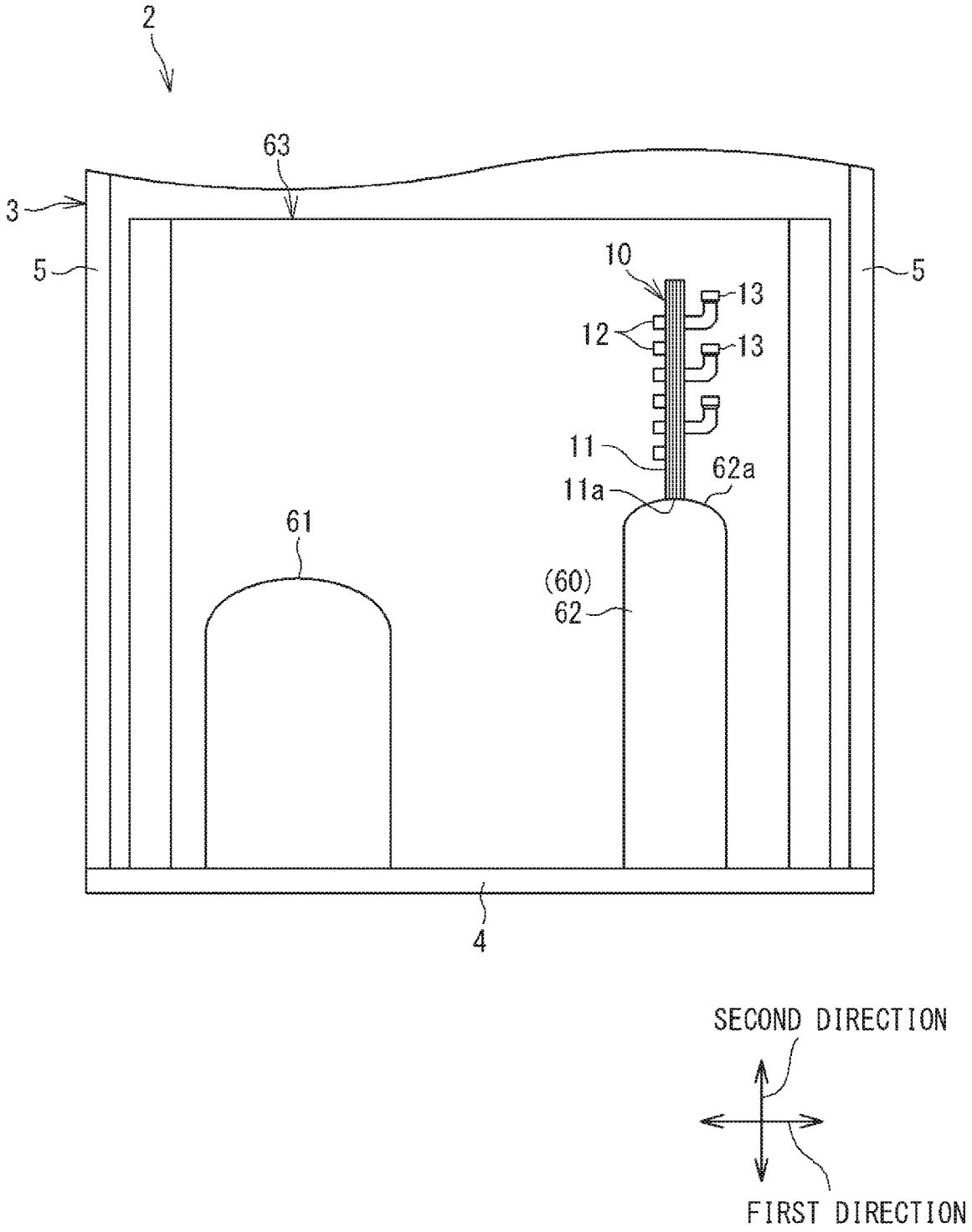
FIG. 5 is a schematic front view of an outdoor unit.

FIG. 5 is a schematic front view of the outdoor unit 2. In FIG. 5, the front panel 6 of the casing 3 is not illustrated, and the heat exchanger 63 is shown in a simplified manner. The refrigerant flow path unit 10 is supported by a fixed-side member 60. The fixed-side member 60 is the casing 3 (bottom plate 4, supports 5, front panel 6, and the like), and hard components (accumulator 62, heat exchanger 63, and the like) that are firmly fixed to the casing 3.

The fixed-side member 60 may be a dedicated component to support the refrigerant flow path unit 10 in addition to the existing components (casing 3, accumulator 62, heat exchanger 63, and the like) of the outdoor unit 2. Note that the compressor 61 is not included in the fixed-side member 60 because the compressor 61 is the source of vibration for the casing 3 during the operation of the compressor 61.

The refrigerant flow path unit 10 is further supported at a distance from the bottom plate 4 by the fixed-side member 60. The state in which the refrigerant flow path unit 10 is "at a distance from" the bottom plate 4 means not only a case where a gap is formed between the bottom plate 4 and the refrigerant flow path unit 10, but also a case where a component is interposed between the bottom plate 4 and the refrigerant flow path unit 10 without a gap.

The component interposed between the bottom plate 4 and the refrigerant flow path unit 10 may be the fixed-side member 60 that supports the refrigerant flow path unit 10, or may be a soft component that does not substantially support the refrigerant flow path unit 10.

The refrigerant flow path unit 10 according to one or more embodiments is disposed above the accumulator (container) 62 which is an existing component of the outdoor unit 2. An end surface 11*a* on the lower side of the unit body 11 of the refrigerant flow path unit 10 in the second direction is firmly fixed to the accumulator 62 by a fastener (screw or the like) (not illustrated) while installed on an upper surface 62*a* of the accumulator 62. As described above, the refrigerant flow path unit 10 is supported at a distance above the bottom plate 4 by the fixed-side member 60 (accumulator 62) other than the compressor 61.

The refrigerant flow path unit 10 and the accumulator 62 are formed from a material that suppresses electrolytic corrosion due to mutual contact. In one or more embodiments, the plates 21, 22, and 23 of the unit body 11 of the refrigerant flow path unit 10 are stainless steel. The accumulator 62 is configured, for example, by insulation paint being applied to the outer surface including the upper surface 62*a*.

The refrigerant flow path unit 10 may be supported by the side surface of the accumulator 62 as long as the refrigerant flow path unit 10 is at a distance from the bottom plate 4. In addition, the refrigerant flow path unit 10 may be supported by a container (receiver or the like) other than the accumulator 62, or may be supported by the supports 5.

Since the functional block described in Patent Literature 1 is attached to the compressor, which is a source of vibration, the operational vibration of the compressor is easily transmitted to the functional block. If the operational vibration is transmitted to the functional block, there is a risk of damage to the connection portions or the like of the functional block to the piping.

One or more embodiments of the present disclosure provide an air conditioner capable of suppressing a refrigerant flow path unit from being damaged by vibration.

Functional Effects of First Embodiments

In the air conditioner 1 according to one or more embodiments, the refrigerant flow path unit 10 is supported at a distance from the bottom plate 4 by the accumulator 62, which is the fixed-side member 60 other than the compressor 61. Thus, it is possible to suppress the operational vibration of the compressor 61 installed on the bottom plate 4 from being transmitted to the refrigerant flow path unit 10. As a result, it is possible to suppress the refrigerant flow path unit 10 from being damaged by the operational vibration. In addition, since the refrigerant flow path unit 10 is located at a distance from the bottom plate 4, even if drain water or the like accumulated on the bottom plate 4 freezes, the occurrence of an ice-up phenomenon in which frozen ice grows excessively can be suppressed at the lower end of the refrigerant flow path unit 10.

Since the accumulator 62 supporting the refrigerant flow path unit 10 is an existing component of the outdoor unit 2, it is not necessary to provide a dedicated component to support the refrigerant flow path unit 10. Thus, the configuration of the outdoor unit 2 can be simplified.

Since the refrigerant flow path unit 10 is disposed above the accumulator 62, the refrigerant flow path unit 10 can be supported by the container as far away from the bottom plate 4 as possible. As a result, it is possible to effectively suppress the operational vibration of the compressor 61 installed on the bottom plate 4 from being transmitted to the refrigerant flow path unit 10. In addition, the occurrence of the ice-up phenomenon can be effectively suppressed at the lower end of the refrigerant flow path unit 10.

Since the refrigerant flow path unit 10 and the accumulator 62 are formed from a material that suppresses electrolytic corrosion due to mutual contact, the occurrence of electrolytic corrosion due to mutual contact can be suppressed even if the refrigerant flow path unit 10 is supported by the accumulator 62.

Second Embodiments

Figure 6:
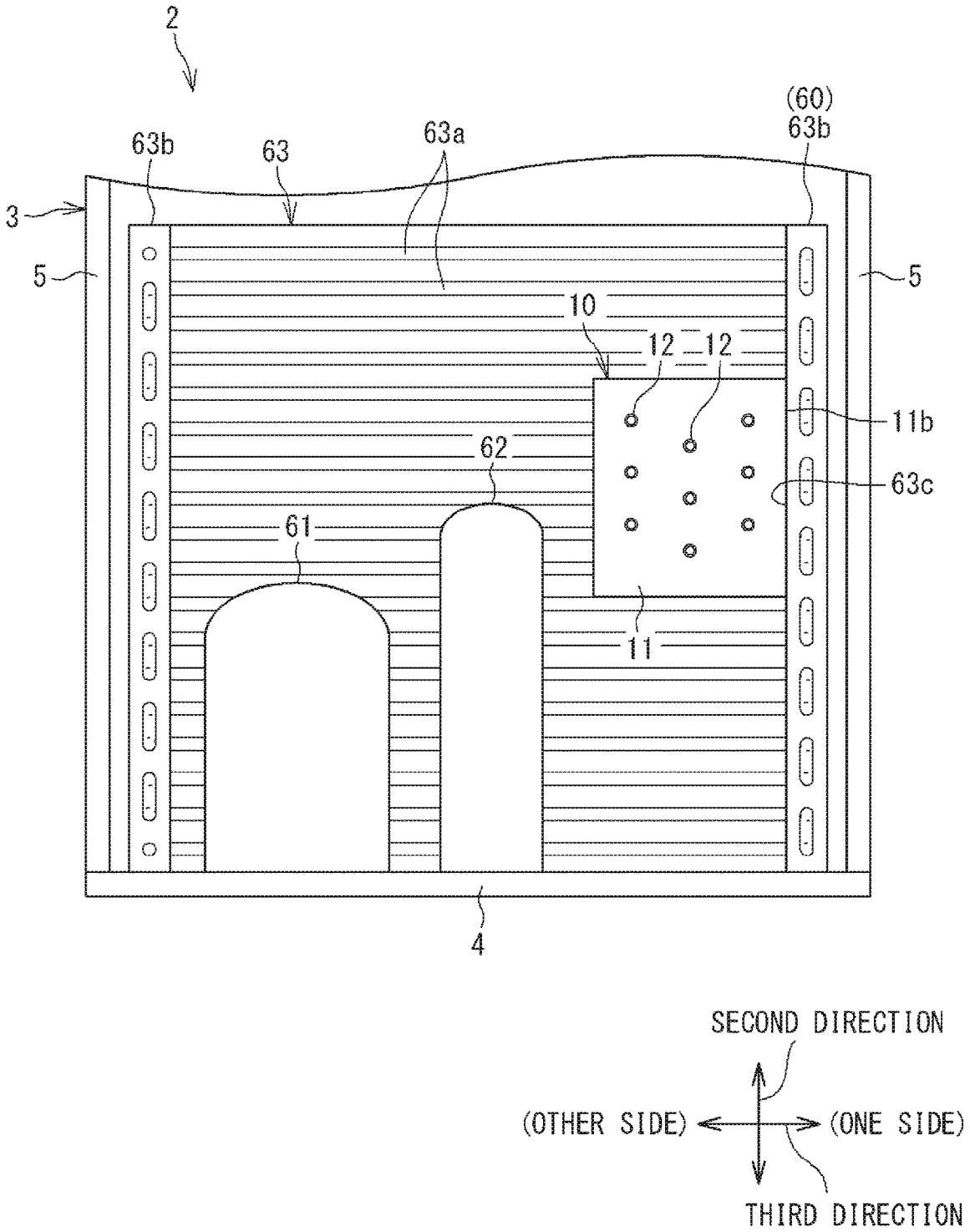
FIG. 6 is a schematic front view of the outdoor unit of an air conditioner according to second embodiments of the present disclosure.

FIG. 6 is a schematic front view of the outdoor unit 2 of an air conditioner according to second embodiments of the present disclosure. In FIG. 6, the front panel 6 of the casing 3 is not illustrated. The refrigerant flow path unit 10 of the outdoor unit 2 according to one or more embodiments is supported by the heat exchanger 63 that is the fixed-side member 60. The heat exchanger 63 has a plurality of heat transfer tubes 63*a* through which the refrigerant flows, and a pair of tube plates 63*b* (see also FIG. 1) that support the heat transfer tubes 63*a*. The plurality of heat transfer tubes 63*a* are arranged at predetermined intervals in the vertical direction, and are each formed long in the horizontal direction. The pair of tube plates 63*b* are installed on the upper surface of the bottom plate 4 in horizontally spaced relation to each other and are formed to be long in the vertical direction.

The refrigerant flow path unit 10 is supported at a distance from the bottom plate 4 by the tube plate 63*b* on one side (right side in FIG. 6) of the heat exchanger 63. In one or more embodiments, a first side surface 11*b* on one side of the unit body 11 in the third direction is firmly fixed to the tube plate 63*b* by a fastener (screw or the like) (not illustrated) while abutting on a side surface 63*c* of the tube plate 63*b* on the one side.

The refrigerant flow path unit 10 and the tube plate 63*b* are formed from a material that suppresses electrolytic corrosion due to mutual contact. In one or more embodiments, the plates 21, 22, and 23 of the unit body 11 of the refrigerant flow path unit 10 are stainless steel. The tube plate 63*b* is configured, for example, by insulation paint being applied to the outer surface including the side surface 63*c*. Other configurations of the second embodiments are similar to those of the first embodiments, and therefore the description thereof will be omitted.

Functional Effects of Second Embodiments

In the air conditioner 1 according to one or more embodiments, the refrigerant flow path unit 10 is supported at a distance from the bottom plate 4 by the tube plate 63*b* of the heat exchanger 63 which is the fixed-side member 60 other than the compressor 61. Thus, it is possible to suppress the operational vibration of the compressor 61 installed on the bottom plate 4 from being transmitted to the refrigerant flow path unit 10. As a result, it is possible to suppress the refrigerant flow path unit 10 from being damaged by the operational vibration. In addition, since the refrigerant flow path unit 10 is located at a distance from the bottom plate 4, it is possible to suppress the occurrence of the ice-up phenomenon as in the first embodiments.

Since the tube plate 63*b* of the heat exchanger 63 which supports the refrigerant flow path unit 10 is an existing component of the outdoor unit 2, it is not necessary to provide a dedicated component to support the refrigerant flow path unit 10. Thus, the configuration of the outdoor unit 2 can be simplified.

Since the refrigerant flow path unit 10 and the tube plate 63*b* are formed from a material that suppresses electrolytic corrosion due to mutual contact, the occurrence of electrolytic corrosion due to mutual contact can be suppressed even if the refrigerant flow path unit 10 is supported by the tube plate 63*b*.

Third Embodiments

Figure 7:
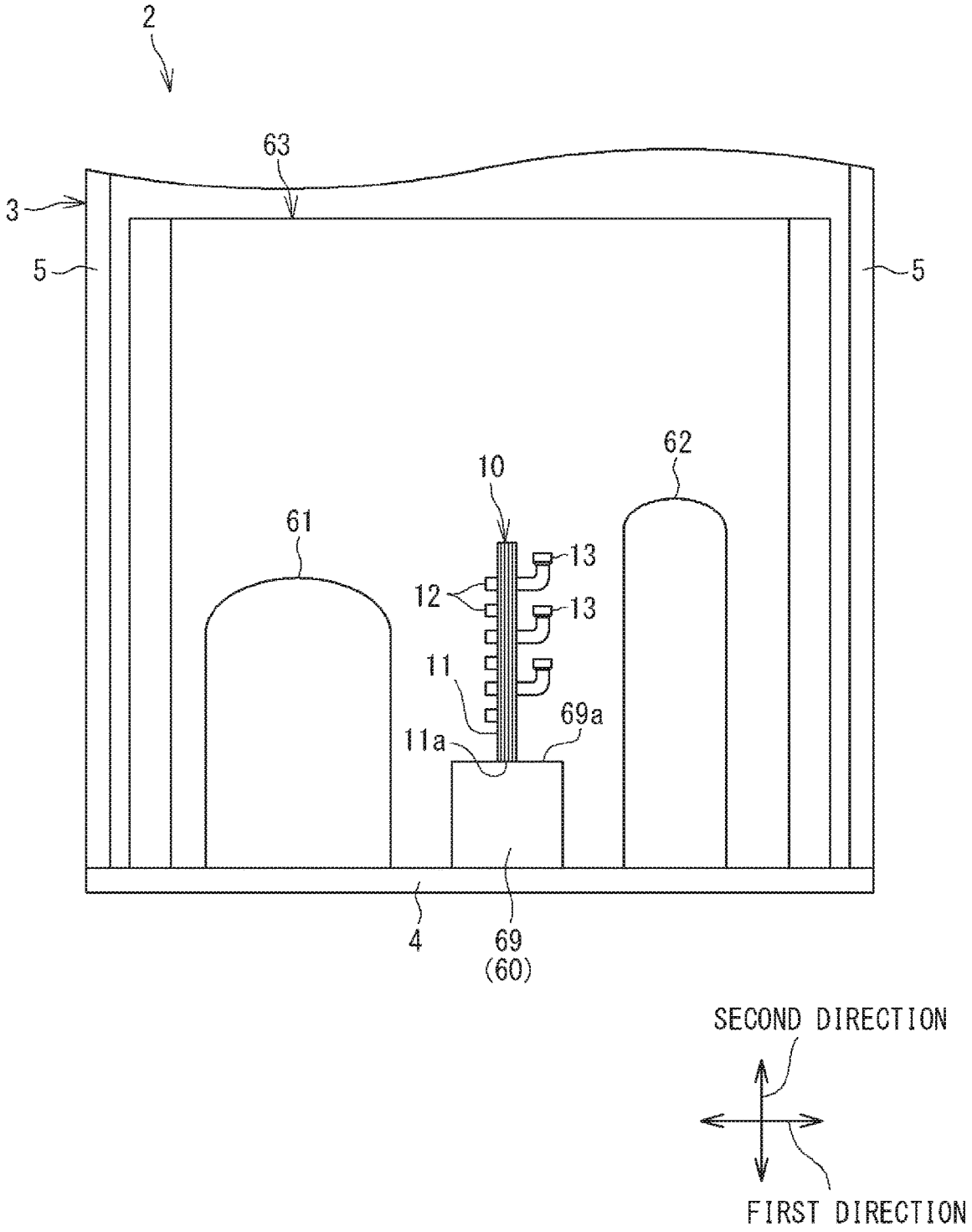
FIG. 7 is a schematic front view of the outdoor unit of an air conditioner according to third embodiments of the present disclosure.

FIG. 7 is a schematic front view of the outdoor unit 2 of an air conditioner according to third embodiments of the present disclosure. In FIG. 7, the front panel 6 of the casing 3 is not illustrated, and the heat exchanger 63 is shown in a simplified manner. The refrigerant flow path unit 10 of the outdoor unit 2 according to one or more embodiments is supported by a spacer 69. The spacer 69 is formed in, for example, a rectangular parallelepiped shape. The spacer 69 is a dedicated component to support the refrigerant flow path unit 10. The spacer 69 is installed on the upper surface of the bottom plate 4 of the casing 3 and fixed to the upper surface. The spacer 69 is a component fixed to the casing 3, and therefore is the fixed-side member 60.

The refrigerant flow path unit 10 is supported at a distance from the bottom plate 4 by the spacer 69. In one or more embodiments, the end surface 11*a* on the lower side of the unit body 11 in the second direction is firmly fixed to the spacer 69 by a fastener (screw or the like) (not illustrated) while installed on an upper surface 69*a* of the spacer 69. The refrigerant flow path unit 10 may be supported by the side surface of the spacer 69 as long as the refrigerant flow path unit 10 is at a distance from the bottom plate 4.

The refrigerant flow path unit 10 and the spacer 69 are formed from a material that suppresses electrolytic corrosion due to mutual contact. In one or more embodiments, the plates 21, 22, and 23 of the unit body 11 of the refrigerant flow path unit 10 are stainless steel. The spacer 69 is configured, for example, by insulation paint being applied to the outer surface including the upper surface 69*a*. Other configurations of the third embodiments are similar to those of the first embodiments, and therefore the description thereof will be omitted.

Functional Effects of Third Embodiments

In the air conditioner 1 according to one or more embodiments, the refrigerant flow path unit 10 is supported at a distance from the bottom plate 4 by the spacer 69, which is the fixed-side member 60 other than the compressor 61. Thus, it is possible to suppress the operational vibration of the compressor 61 installed on the bottom plate 4 from being transmitted to the refrigerant flow path unit 10. As a result, it is possible to suppress the refrigerant flow path unit 10 from being damaged by the operational vibration. In addition, since the refrigerant flow path unit 10 is located at a distance from the bottom plate 4, it is possible to suppress the occurrence of the ice-up phenomenon as in the first embodiments.

Since the refrigerant flow path unit 10 and the spacer 69 are formed from a material that suppresses electrolytic corrosion due to mutual contact, the occurrence of electrolytic corrosion due to mutual contact can be suppressed even if the refrigerant flow path unit 10 is supported by the spacer 69.

Fourth Embodiments

Figure 8:
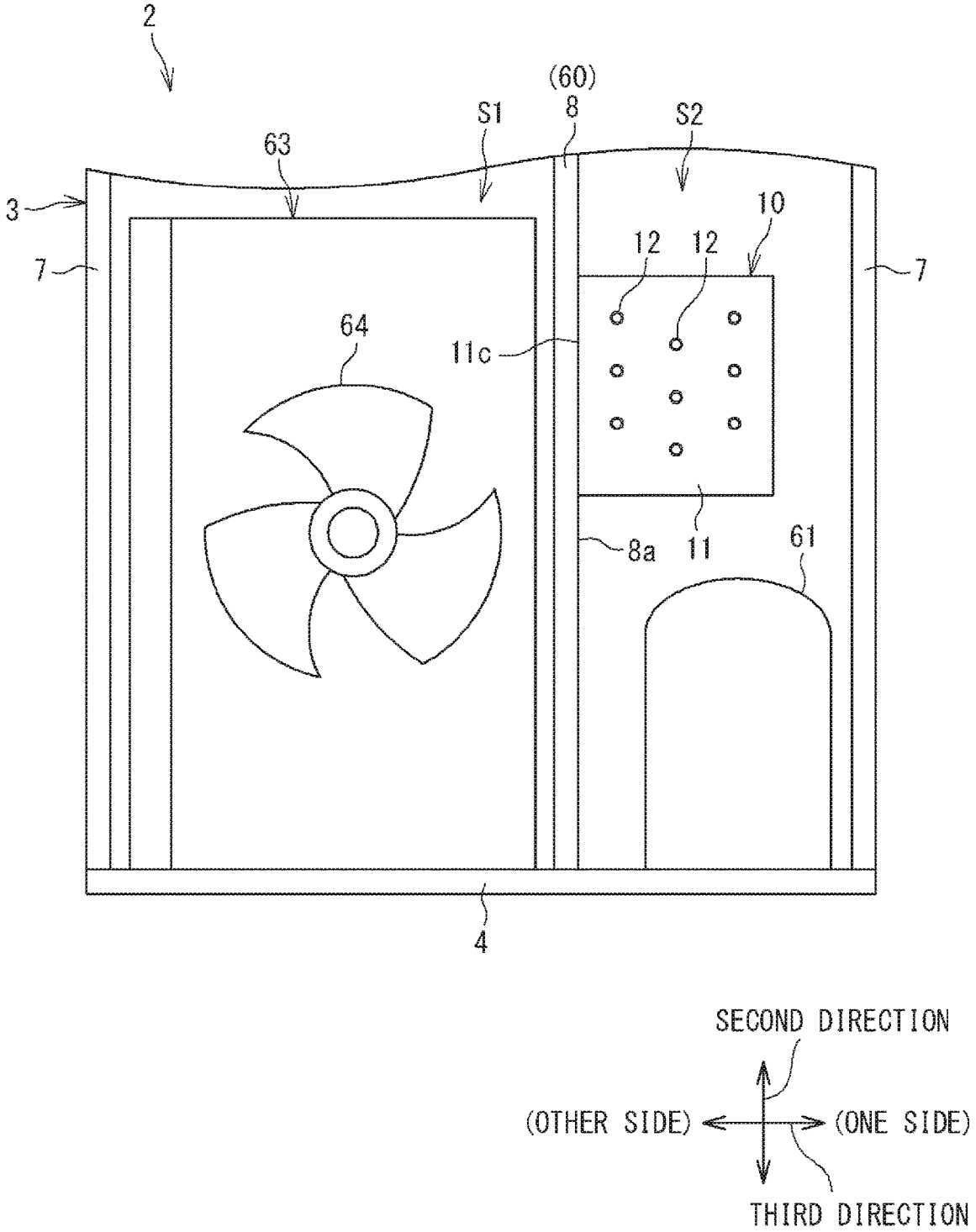
FIG. 8 is a schematic front view of the outdoor unit of an air conditioner according to fourth embodiments of the present disclosure.

FIG. 8 is a schematic front view of the outdoor unit 2 of an air conditioner according to fourth embodiments of the present disclosure. The outdoor unit 2 according to one or more embodiments is a so-called trunk-shaped outdoor unit. The outdoor unit 2 includes a partition plate 8 that partitions the internal space of the casing 3 into a fan chamber S1 and a machine chamber S2. The partition plate 8 is formed to be long in the vertical direction.

The casing 3 has the bottom plate 4, the front panel (not illustrated in FIG. 8), and a side plate 7. The side plate 7 and the partition plate 8 are installed on the upper surface of the bottom plate 4 and fixed to the upper surface. The partition plate 8 is a component fixed to the casing 3 and therefore is the fixed-side member 60. The fan chamber S1 houses the heat exchanger 63, the fan 64, and the like. The machine chamber S2 houses the refrigerant flow path unit 10, the compressor 61, and the like.

The refrigerant flow path unit 10 is supported at a distance from the bottom plate 4 by the partition plate 8. In one or more embodiments, a second side surface 11*c* on the other side of the unit body 11 in the third direction is firmly fixed to the partition plate 8 by a fastener (screw or the like) (not illustrated) while abutting on a plate surface 8*a* of the partition plate 8 on the machine chamber S2 side.

The refrigerant flow path unit 10 and the partition plate 8 are formed from a material that suppresses electrolytic corrosion due to mutual contact. In one or more embodiments, the plates 21, 22, and 23 of the unit body 11 of the refrigerant flow path unit 10 are stainless steel. The partition plate 8 is configured, for example, by insulation paint being applied to the outer surface including the plate surface 8*a*. Other configurations of one or more embodiments are similar to those of the first embodiments, and therefore the description thereof will be omitted.

Functional Effects of Fourth Embodiments

In the air conditioner 1 according to one or more embodiments, the refrigerant flow path unit 10 is supported at a distance from the bottom plate 4 by the partition plate 8, which is the fixed-side member 60 other than the compressor 61. Thus, it is possible to suppress the operational vibration of the compressor 61 installed on the bottom plate 4 from being transmitted to the refrigerant flow path unit 10. As a result, it is possible to suppress the refrigerant flow path unit 10 from being damaged by the operational vibration. In addition, since the refrigerant flow path unit 10 is located at a distance from the bottom plate 4, it is possible to suppress the occurrence of the ice-up phenomenon as in the first embodiments.

Since the partition plate 8 of the casing 3 which supports the refrigerant flow path unit 10 is an existing component of the outdoor unit 2, it is not necessary to provide a dedicated component to support the refrigerant flow path unit 10. Thus, the configuration of the outdoor unit 2 can be simplified.

Since the refrigerant flow path unit 10 and the partition plate 8 are formed from a material that suppresses electrolytic corrosion due to mutual contact, the occurrence of electrolytic corrosion due to mutual contact can be suppressed even if the refrigerant flow path unit 10 is supported by the partition plate 8.

Fifth Embodiments

Figure 9:
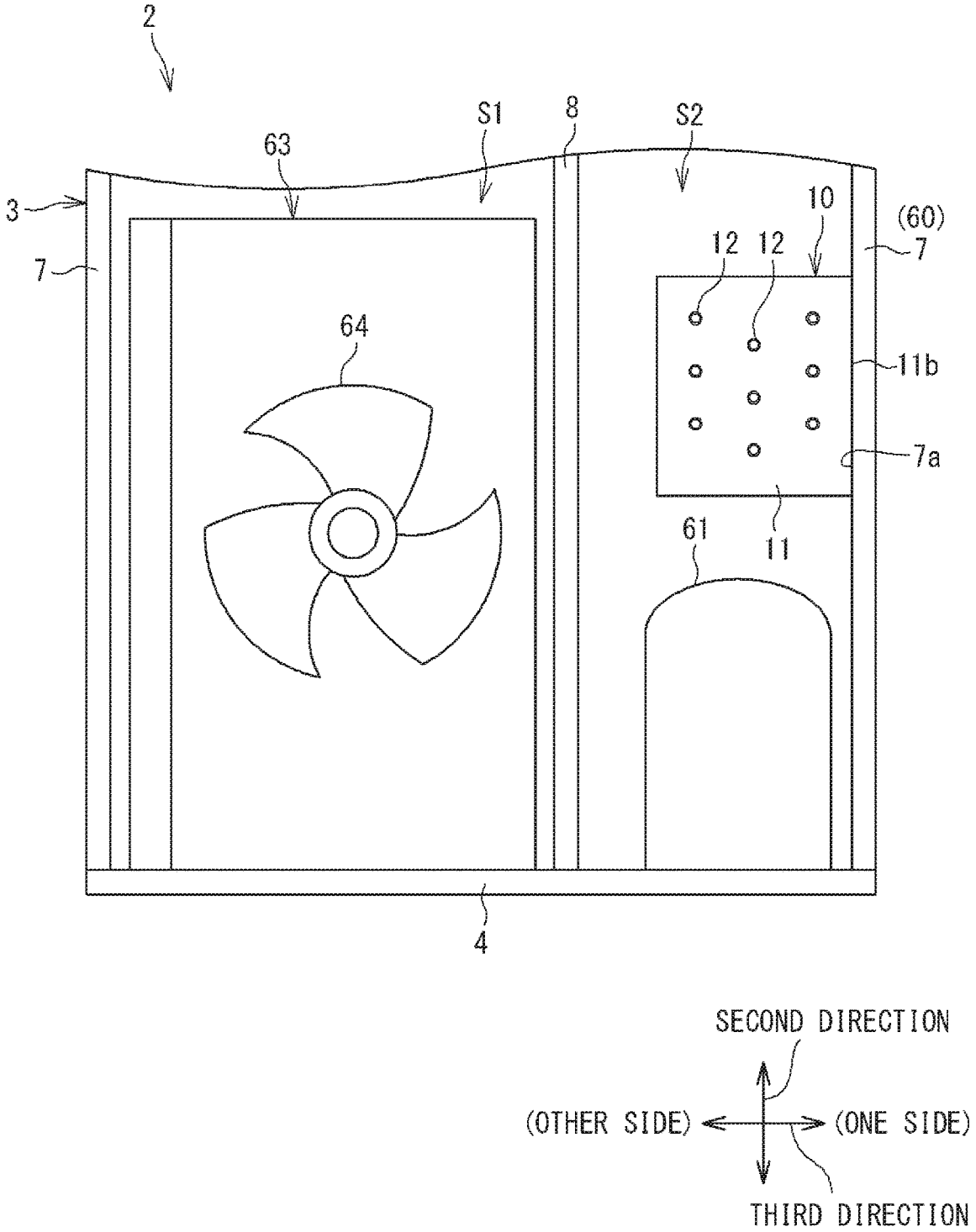
FIG. 9 is a schematic front view of the outdoor unit of an air conditioner according to fifth embodiments of the present disclosure.

FIG. 9 is a schematic front view of the outdoor unit 2 of an air conditioner according to fifth embodiments of the present disclosure. In FIG. 9, the front panel of the casing 3 is not illustrated similarly to FIG. 8. One or more embodiments are modifications of the fourth embodiments. The refrigerant flow path unit 10 according to one or more embodiments is supported at a distance from the bottom plate 4 by the side plate 7 of the casing 3. In one or more embodiments, the first side surface 11*b* on one side of the unit body 11 in the third direction is firmly fixed to the side plate 7 by a fastener (screw or the like) (not illustrated) while abutting on a plate surface 7*a* of the side plate 7 facing the machine chamber S2.

The refrigerant flow path unit 10 and the side plate 7 are formed from a material that suppresses electrolytic corrosion due to mutual contact. In one or more embodiments, the plates 21, 22, and 23 of the unit body 11 of the refrigerant flow path unit 10 are stainless steel. The side plate 7 is configured, for example, by insulation paint being applied to the outer surface including the plate surface 7*a*. Other configurations of one or more embodiments are similar to those of the fourth embodiments, and therefore the description thereof will be omitted.

Functional Effects of Fifth Embodiments

In the air conditioner 1 according to one or more embodiments, the refrigerant flow path unit 10 is supported at a distance from the bottom plate 4 by the side plate 7 of the casing 3 which is the fixed-side member 60 other than the compressor 61. Thus, it is possible to suppress the operational vibration of the compressor 61 installed on the bottom plate 4 from being transmitted to the refrigerant flow path unit 10. As a result, it is possible to suppress the refrigerant flow path unit 10 from being damaged by the operational vibration. In addition, since the refrigerant flow path unit 10 is located at a distance from the bottom plate 4, it is possible to suppress the occurrence of the ice-up phenomenon as in the first embodiments.

Since the side plate 7 of the casing 3 which supports the refrigerant flow path unit 10 is an existing component of the outdoor unit 2, it is not necessary to provide a dedicated component to support the refrigerant flow path unit 10. Thus, the configuration of the outdoor unit 2 can be simplified.

Since the refrigerant flow path unit 10 and the side plate 7 are formed from a material that suppresses electrolytic corrosion due to mutual contact, the occurrence of electrolytic corrosion due to mutual contact can be suppressed even if the refrigerant flow path unit 10 is supported by the side plate 7.

Sixth Embodiments

Figure 10:
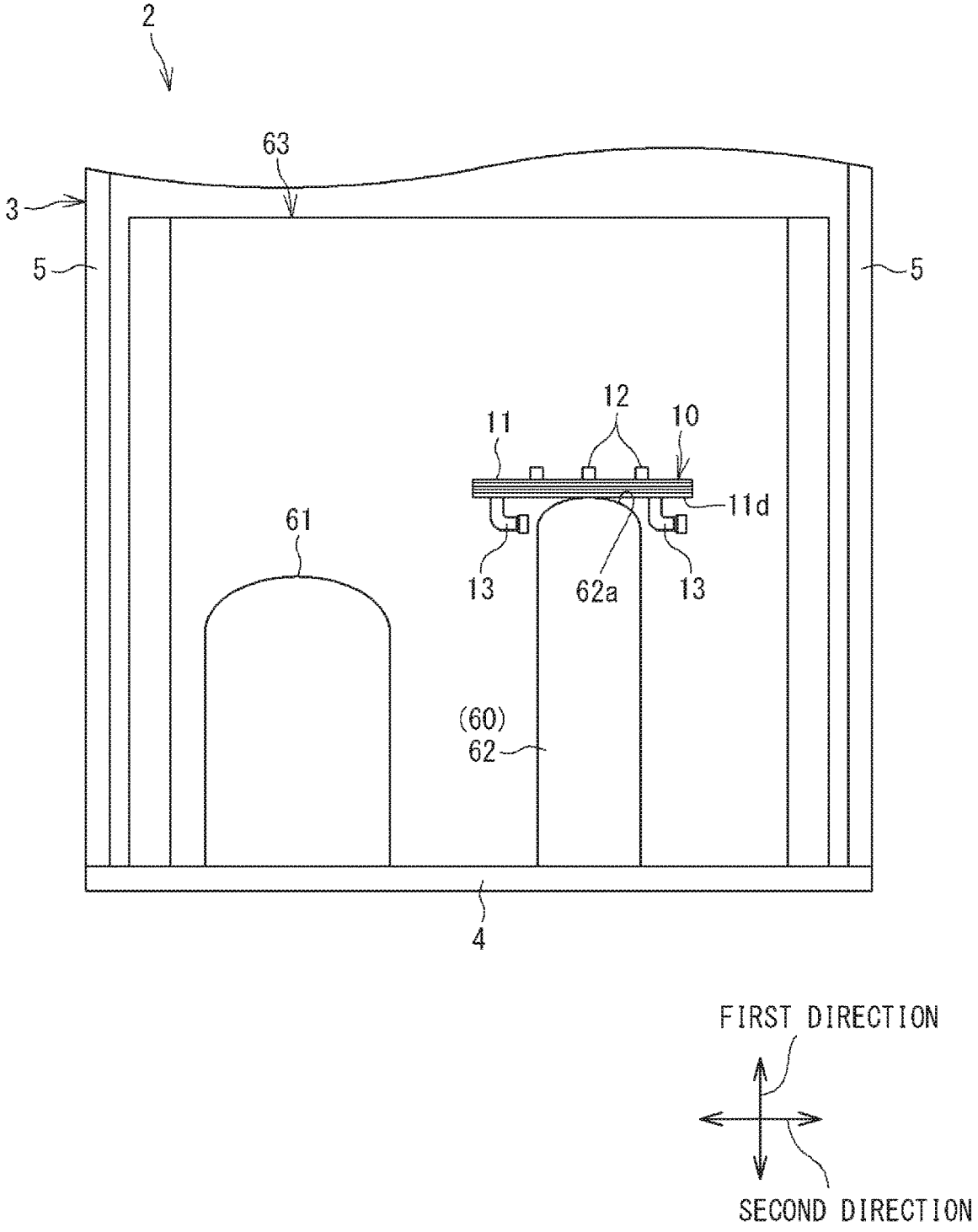
FIG. 10 is a schematic front view of the outdoor unit of an air conditioner according to sixth embodiments of the present disclosure.

FIG. 10 is a schematic front view of the outdoor unit 2 of an air conditioner according to sixth embodiments of the present disclosure. In FIG. 10, the front panel 6 of the casing 3 is not illustrated, and the heat exchanger 63 is shown in a simplified manner (the same applies to FIGS. 11 to 19). One or more embodiments are modifications of the first embodiments (see FIG. 5). The refrigerant flow path unit 10 of the outdoor unit 2 according to one or more embodiments is housed inside the casing 3, in a lying orientation with the plate surface (one surface) of the unit body 11 along the horizontal direction.

A plate surface 11*d* on the lower side (in this case, the second joint pipe 13 side) of the unit body 11 of the refrigerant flow path unit 10 is installed on the upper surface 62*a* of the accumulator 62, which is the fixed-side member 60. In this state, the unit body 11 is firmly fixed to the accumulator 62 by a fastener (screw or the like) (not illustrated).

As described above, the refrigerant flow path unit 10 is supported at a distance above the bottom plate 4 by the fixed-side member 60 (accumulator 62) other than the compressor 61. Other configurations of one or more embodiments are similar to those of the first embodiments, and therefore the description thereof will be omitted. The air conditioner 1 according to one or more embodiments has functional effects similar to the first embodiments.

Seventh Embodiments

Figure 11:
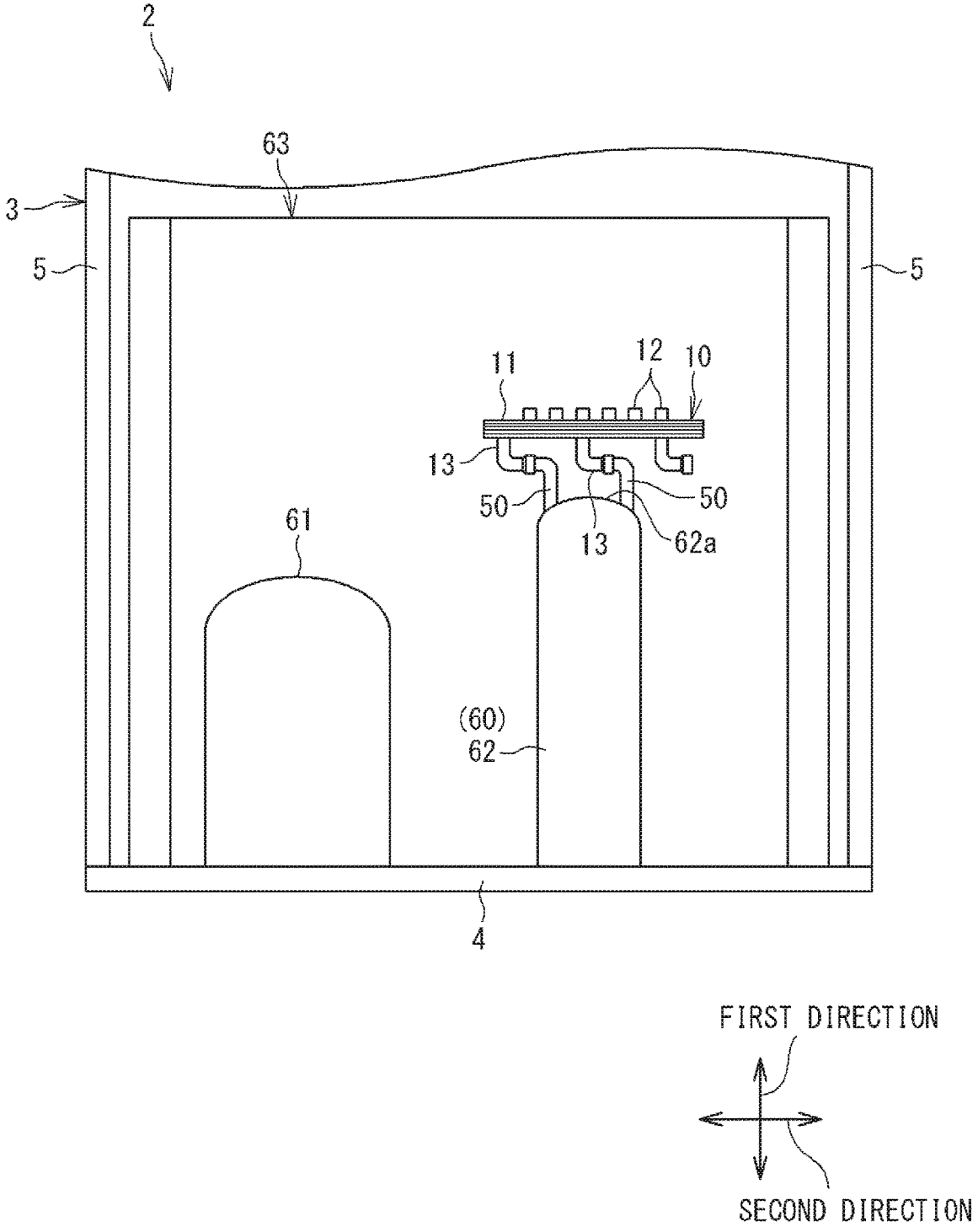
FIG. 11 is a schematic front view of the outdoor unit of an air conditioner according to seventh embodiments of the present disclosure.

FIG. 11 is a schematic front view of the outdoor unit 2 of an air conditioner according to seventh embodiments of the present disclosure. One or more embodiments are other modifications of the first embodiments (see FIG. 5). The refrigerant flow path unit 10 of the outdoor unit 2 according to one or more embodiments is disposed in the lying orientation at a distance above the upper surface 62*a* of the accumulator 62.

The refrigerant flow path unit 10 is disposed with the second joint pipes 13 facing downward. The predetermined number (two in FIG. 11) of second joint pipes 13 are connected to the refrigerant pipes 50 extending from the upper surface 62*a* of the accumulator 62. Thus, the refrigerant flow path unit 10 is firmly fixed to the accumulator 62 with the predetermined number of refrigerant pipes 50 interposed therebetween. As described above, the refrigerant flow path unit 10 is supported at a distance above the bottom plate 4 by the fixed-side member 60 (accumulator 62) other than the compressor 61.

Each of the refrigerant pipes 50 extending from the accumulator 62 is formed from a material that suppresses electrolytic corrosion due to contact with the refrigerant flow path unit 10. In one or more embodiments, the refrigerant pipe 50 is configured by, for example, by insulation paint being applied to the contact portions with the accumulator 62 and the second joint pipe 13. Other configurations of one or more embodiments are similar to those of the first embodiments, and therefore the description thereof will be omitted.

The air conditioner 1 according to one or more embodiments, similarly to the first embodiments, can suppress the refrigerant flow path unit 10 from being damaged by the operational vibration of the compressor 61. In addition, the occurrence of the ice-up phenomenon can be effectively suppressed.

Since the refrigerant pipes 50 and the accumulator 62 which support the refrigerant flow path unit 10 are existing components, it is not necessary to provide dedicated components to support the refrigerant flow path unit 10. In addition, in the first embodiments, a dedicated fastener for fixing the refrigerant flow path unit 10 to the accumulator 62 is required, but in one or more embodiments, a dedicated fastener is not required. Thus, the configuration of the outdoor unit 2 can also be simplified.

Since the refrigerant flow path unit 10, the refrigerant pipes 50, and the accumulator 62 are formed from a material that suppresses electrolytic corrosion due to mutual contact, the occurrence of electrolytic corrosion due to mutual contact can be suppressed even if the refrigerant flow path unit 10 is supported by the accumulator 62 with the refrigerant pipes 50 interposed therebetween.

The refrigerant pipe 50 and the second joint pipe 13 illustrated in FIG. 11 are both bent in the horizontal direction and connected to each other, but may be linearly extended in the vertical direction and connected to each other. The refrigerant flow path unit 10 is disposed with the second joint pipes 13 facing downward, but may be disposed with the first joint pipes 12 facing downward. In this case, the refrigerant pipe 50 may extend straight upward and be connected to the first joint pipe 12.

Eighth Embodiments

Figure 12:
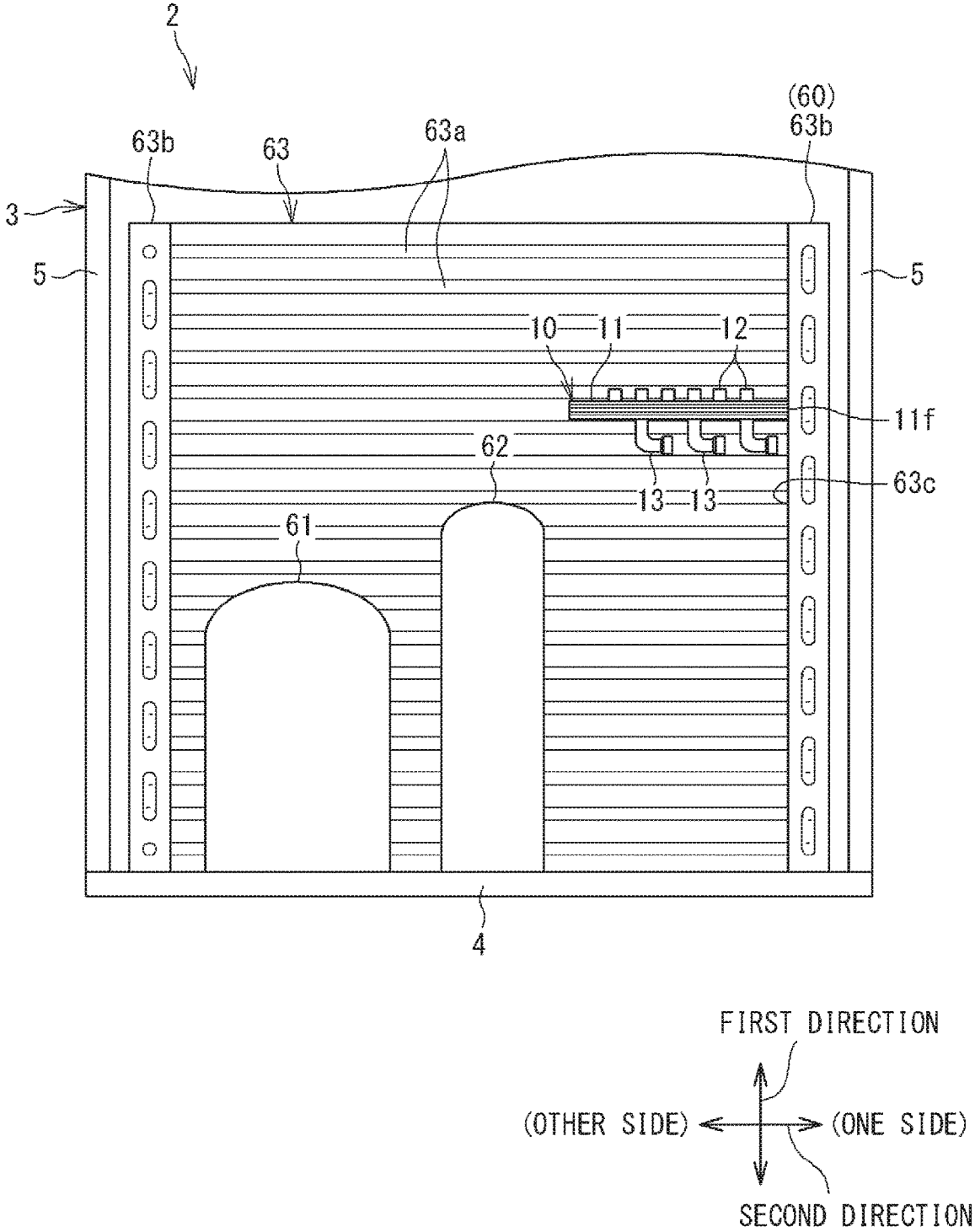
FIG. 12 is a schematic front view of the outdoor unit of an air conditioner according to eighth embodiments of the present disclosure.

FIG. 12 is a schematic front view of the outdoor unit 2 of an air conditioner according to eighth embodiments of the present disclosure. One or more embodiments are modifications of the second embodiments (see FIG. 6). The refrigerant flow path unit 10 of the outdoor unit 2 according to one or more embodiments is supported in the lying orientation by the heat exchanger 63.

The refrigerant flow path unit 10 is supported at a distance from the bottom plate 4 by the tube plate 63*b* on one side (right side in FIG. 12) of the heat exchanger 63. In one or more embodiments, an end surface 11*f* on one side of the unit body 11 in the second direction abuts on the side surface 63*c* of the one side tube plate 63*b*. In this state, the unit body 11 is firmly fixed to the tube plate 63*b* by a fastener (screw or the like) (not illustrated).

As described above, the refrigerant flow path unit 10 is supported at a distance above the bottom plate 4 by the fixed-side member 60 (heat exchanger 63) other than the compressor 61. Other configurations of one or more embodiments are similar to those of the second embodiments, and therefore the description thereof will be omitted. The air conditioner 1 according to one or more embodiments has functional effects similar to the second embodiments.

Ninth Embodiments

Figure 13:
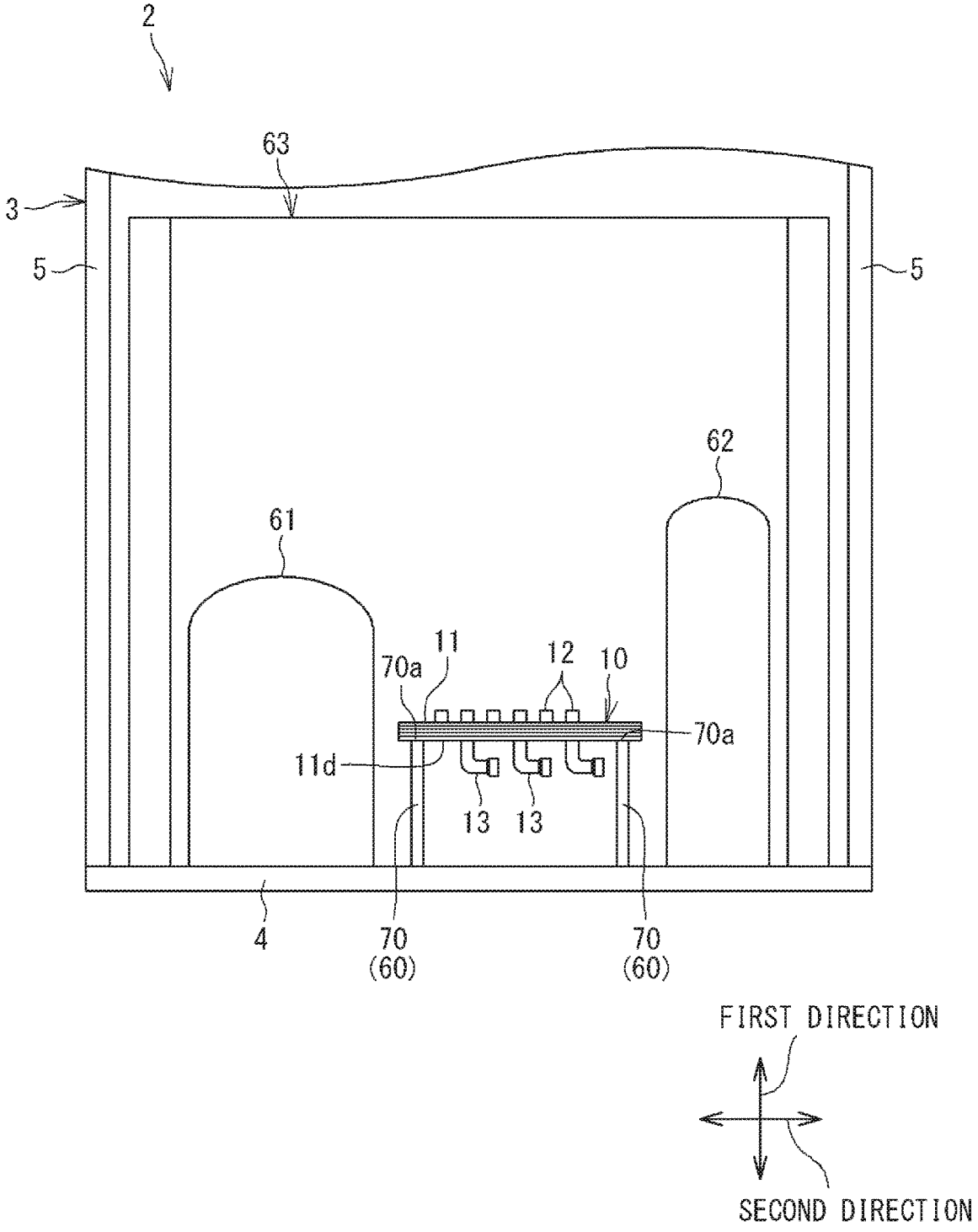
FIG. 13 is a schematic front view of the outdoor unit of an air conditioner according to ninth embodiments of the present disclosure.

FIG. 13 is a schematic front view of the outdoor unit 2 of an air conditioner according to ninth embodiments of the present disclosure. One or more embodiments are modifications of the third embodiments (see FIG. 7). The refrigerant flow path unit 10 of the outdoor unit 2 according to one or more embodiments is housed in the lying orientation inside the casing 3.

The refrigerant flow path unit 10 is supported at a distance from the bottom plate 4 by a predetermined number (for example, four) of supports 70. Each of the supports 70 are formed in a columnar shape, for example. The support 70 is a dedicated component to support the refrigerant flow path unit 10. The end surface on one side of the support 70 in the longitudinal direction is installed on the upper surface of the bottom plate 4 of the casing 3 and fixed to the upper surface. The support 70 is a component fixed to the casing 3, and therefore is the fixed-side member 60.

The plate surface 11*d* on the lower side of the unit body 11 of the refrigerant flow path unit 10 is installed on an end surface (upper surface) 70*a* on the other side of the support 70 in the longitudinal direction, the support 70 being installed at each of the four corners of the plate surface 11*d*. In this state, the unit body 11 is firmly fixed to the support 70 by a fastener (screw or the like) (not illustrated). As described above, the refrigerant flow path unit 10 is supported at a distance above the bottom plate 4 by the fixed-side member 60 (support 70) other than the compressor 61.

The support 70 is formed from a material that suppresses electrolytic corrosion due to contact with the refrigerant flow path unit 10. In one or more embodiments, the support 70 is configured, for example, by insulation paint being applied to the outer surface including the end surface 70*a*. Other configurations of one or more embodiments are similar to those of the third embodiments, and therefore the description thereof will be omitted.

In the air conditioner 1 according to one or more embodiments, the refrigerant flow path unit 10 is supported at a distance from the bottom plate 4 by the support 70, which is the fixed-side member 60 other than the compressor 61. Thus, it is possible to suppress the operational vibration of the compressor 61 installed on the bottom plate 4 from being transmitted to the refrigerant flow path unit 10. As a result, it is possible to suppress the refrigerant flow path unit 10 from being damaged by the operational vibration. In addition, since the refrigerant flow path unit 10 is located at a distance from the bottom plate 4, it is possible to suppress the occurrence of the ice-up phenomenon as in the first embodiments.

Since the refrigerant flow path unit 10 and the support 70 are formed from a material that suppresses electrolytic corrosion due to mutual contact, the occurrence of electrolytic corrosion due to mutual contact can be suppressed even if the refrigerant flow path unit 10 is supported by the support 70.

The refrigerant flow path unit 10 may be supported by the side surface of the support 70 as long as the refrigerant flow path unit 10 is at a distance from the bottom plate 4. In addition, the refrigerant flow path unit 10 in the lying orientation according to one or more embodiments may be supported by the spacer 69 as in the third embodiments.

Tenth Embodiments

Figure 14:
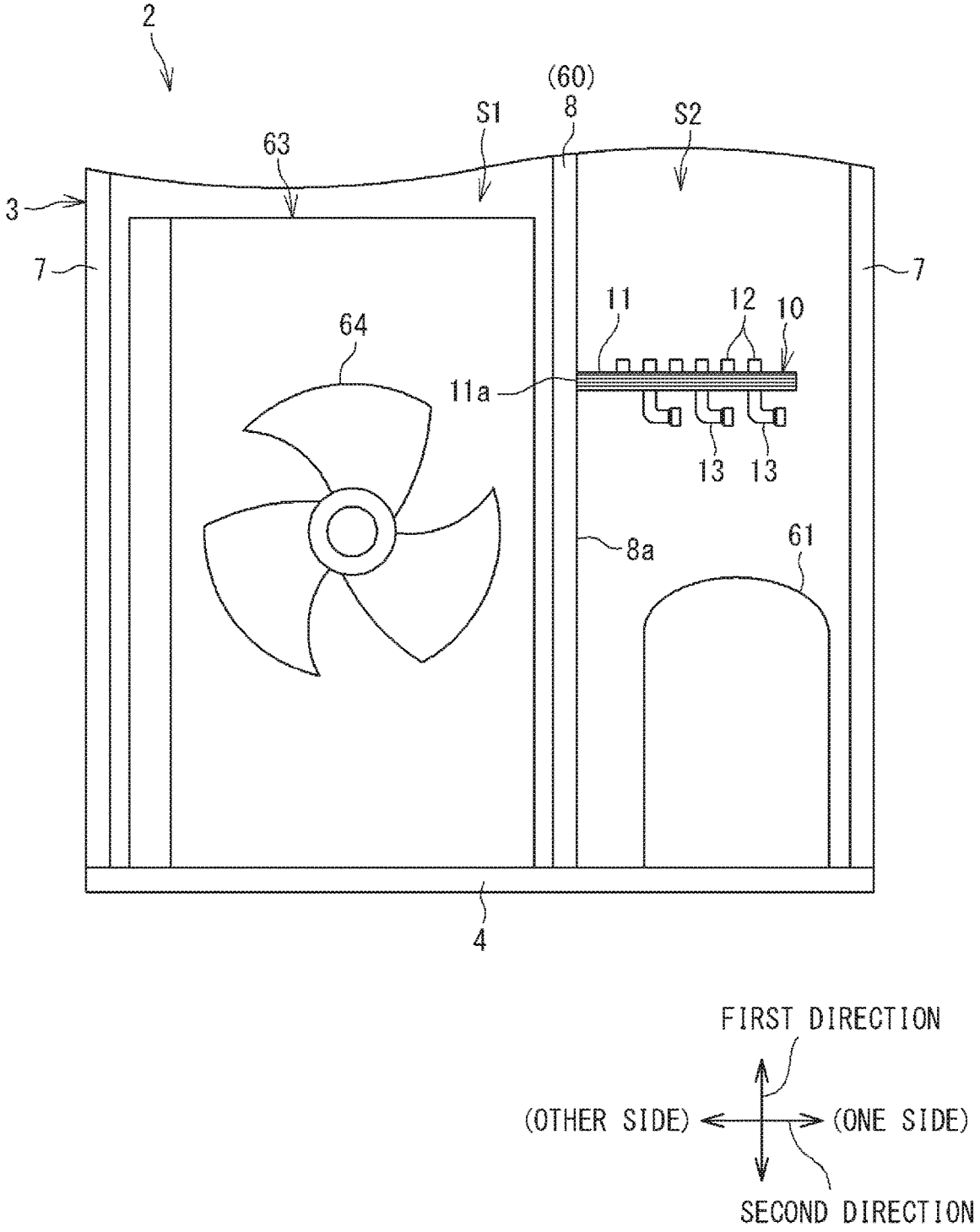
FIG. 14 is a schematic front view of the outdoor unit of an air conditioner according to tenth embodiments of the present disclosure.

FIG. 14 is a schematic front view of the outdoor unit 2 of an air conditioner according to tenth embodiments of the present disclosure. One or more embodiments are modifications of the fourth embodiments (see FIG. 8). The refrigerant flow path unit 10 of the outdoor unit 2 according to one or more embodiments is supported in the lying orientation at a position away from the bottom plate 4 in the machine chamber S2 by the partition plate 8 of the outdoor unit 2.

In one or more embodiments, the end surface 11*a* on the other side of the unit body 11 in the second direction abuts on the plate surface 8*a* of the partition plate 8 on the machine chamber S2 side. In this state, the unit body 11 is firmly fixed to the partition plate 8 by a fastener (screw or the like) (not illustrated).

As described above, the refrigerant flow path unit 10 is supported at a distance above the bottom plate 4 by the fixed-side member 60 (partition plate 8) other than the compressor 61. Other configurations of one or more embodiments are similar to those of the fourth embodiments, and therefore the description thereof will be omitted. The air conditioner 1 according to one or more embodiments has functional effects similar to the fourth embodiments.

Eleventh Embodiments

Figure 15:
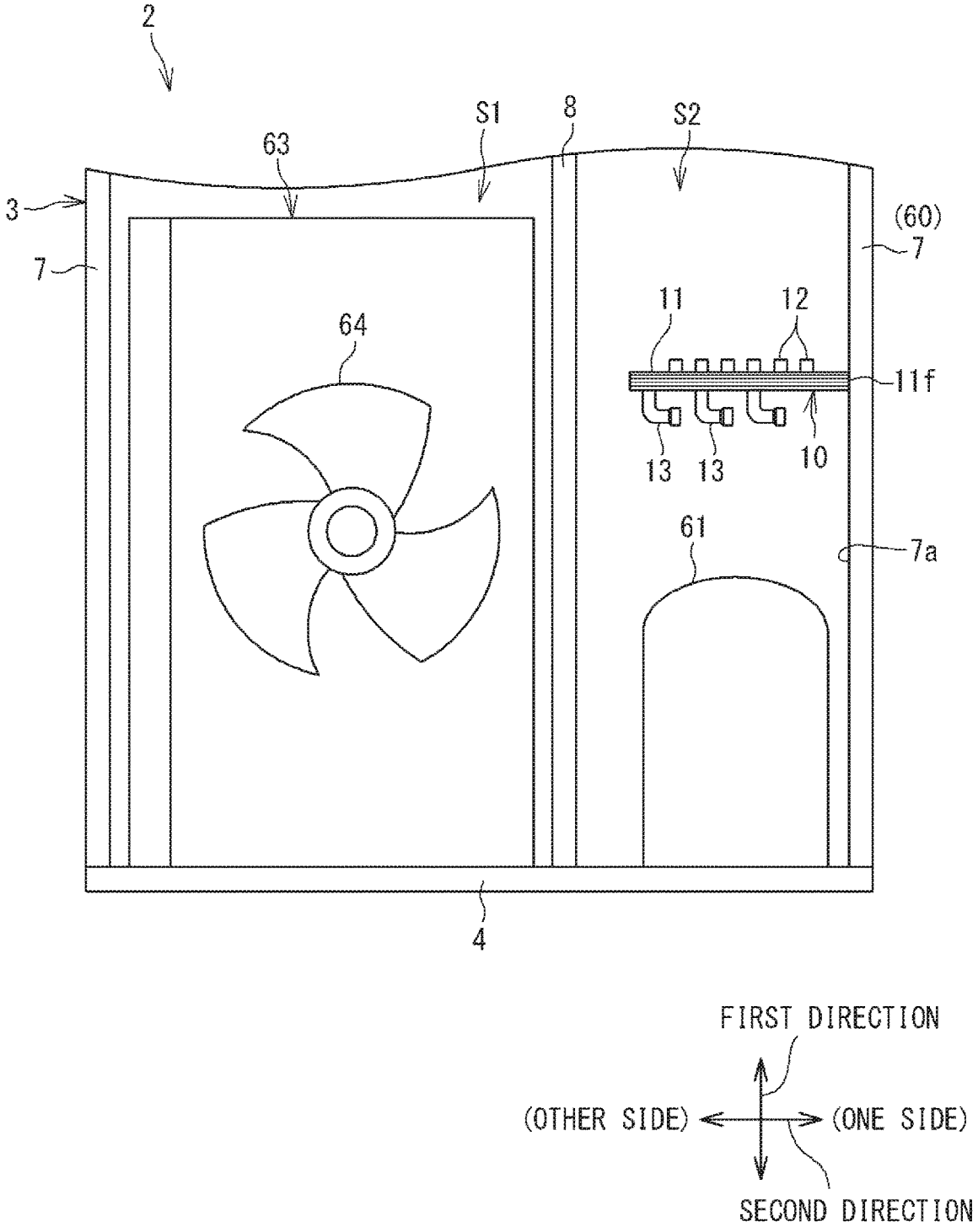
FIG. 15 is a schematic front view of the outdoor unit of an air conditioner according to eleventh embodiments of the present disclosure.

FIG. 15 is a schematic front view of the outdoor unit 2 of an air conditioner according to eleventh embodiments of the present disclosure. One or more embodiments are modifications of the fifth embodiments (see FIG. 9). The refrigerant flow path unit 10 of the outdoor unit 2 according to one or more embodiments is supported in the lying orientation at a position away from the bottom plate 4 in the machine chamber S2 by the side plate 7 of the casing 3.

In one or more embodiments, the end surface 11*f* on one side of the unit body 11 in the second direction abuts on the plate surface 7*a* of the side plate 7 facing the machine chamber S2. In this state, the unit body 11 is firmly fixed to the side plate 7 by a fastener (screw or the like) (not illustrated).

As described above, the refrigerant flow path unit 10 is supported at a distance above the bottom plate 4 by the fixed-side member 60 (side plate 7) other than the compressor 61. Other configurations of one or more embodiments are similar to those of the fifth embodiments, and therefore the description thereof will be omitted. The air conditioner 1 according to one or more embodiments has functional effects similar to the fifth embodiments.

Twelfth Embodiments

Figure 16:
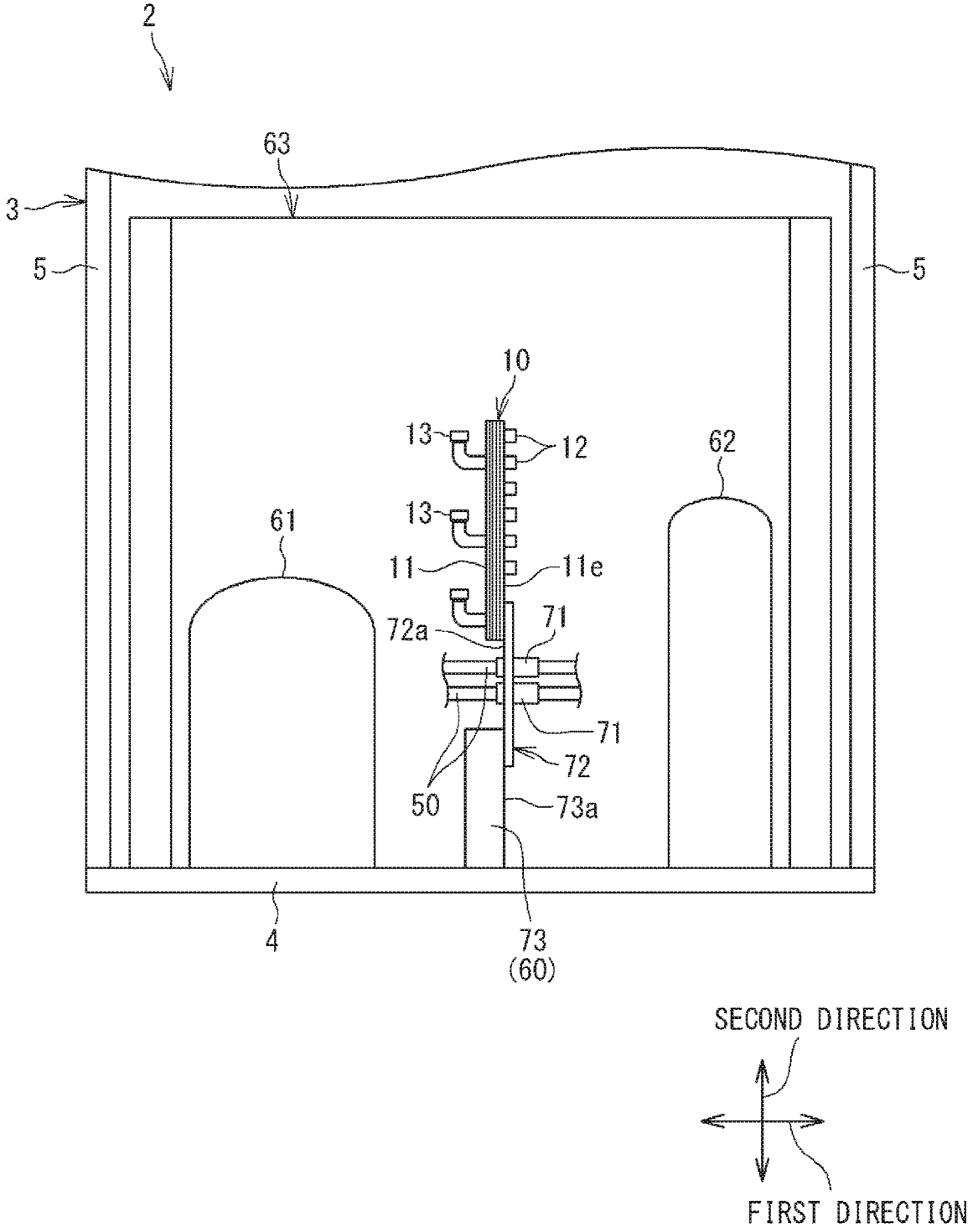
FIG. 16 is a schematic front view of the outdoor unit of an air conditioner according to twelfth embodiments of the present disclosure.

FIG. 16 is a schematic front view of the outdoor unit 2 of an air conditioner according to twelfth embodiments of the present disclosure. A predetermined number (two in FIG. 16) of shutoff valves 71 are housed in the casing 3 of the outdoor unit 2 according to one or more embodiments. Each of the shutoff valves 71 is connected to the refrigerant pipe 50. The shutoff valve 71 allows the flow of the refrigerant by being opened, and blocks the flow of the refrigerant by being closed.

The shutoff valve 71 is fixed to a mounting plate 72 by a fastener (screw or the like) (not illustrated). The mounting plate 72 is fixed to a support plate 73. The mounting plate 72 and the support plate 73 are both disposed in the casing 3, with respective plate surfaces 72*a* and 73*a* aligned in the vertical direction. The lower portion of one of the plate surfaces 72*a* of the mounting plate 72 is overlapped with the upper portion of one of the plate surfaces 73*a* of the support plate 73. In this state, the mounting plate 72 is firmly fixed to the support plate 73 by a fastener (screw or the like) (not illustrated). The support plate 73 is installed on the upper surface of the bottom plate 4 and fixed to the upper surface. Therefore, since the support plate 73 is a component fixed to the casing 3, and therefore is the fixed-side member 60.

The refrigerant flow path unit 10 is supported in the standing orientation by the support plate 73 with the mounting plate 72 interposed therebetween. In one or more embodiments, the lower portion of a plate surface 11*e* on one side (here, the first joint pipe 12 side) of the unit body 11 abuts on the upper portion of the one plate surface 72*a* of the mounting plate 72. In this state, the unit body 11 is firmly fixed to the mounting plate 72 by a fastener (screw or the like) (not illustrated). As described above, the refrigerant flow path unit 10 is supported at a distance above the bottom plate 4 by the fixed-side member 60 (support plate 73) other than the compressor 61, with the mounting plate 72 interposed therebetween.

The mounting plate 72 and the support plate 73 are formed from a material that suppresses electrolytic corrosion due to contact with the refrigerant flow path unit 10. In one or more embodiments, the mounting plate 72 is configured, for example, by insulation paint being applied to the outer surface including the one plate surface 72*a*. The support plate 73 is configured, for example, by insulation paint being applied to the outer surface including the one plate surface 73*a*. Other configurations of one or more embodiments are similar to those of the first embodiments, and therefore the description thereof will be omitted.

In the air conditioner 1 according to one or more embodiments, the refrigerant flow path unit 10 is supported at a distance from the bottom plate 4 by the support plate 73, which is the fixed-side member 60 other than the compressor 61. Thus, it is possible to suppress the operational vibration of the compressor 61 installed on the bottom plate 4 from being transmitted to the refrigerant flow path unit 10. As a result, it is possible to suppress the refrigerant flow path unit 10 from being damaged by the operational vibration. In addition, since the refrigerant flow path unit 10 is located at a distance from the bottom plate 4, it is possible to suppress the occurrence of the ice-up phenomenon as in the first embodiments.

Since the support plate 73 supporting the refrigerant flow path unit 10 is an existing component that supports the shutoff valves 71, with the mounting plate 72 interposed therebetween, in the outdoor unit 2, it is not necessary to provide a dedicated component to support the refrigerant flow path unit 10. Thus, the configuration of the outdoor unit 2 can be simplified.

Since the refrigerant flow path unit 10, the mounting plate 72, and the support plate 73 are formed from a material that suppresses electrolytic corrosion due to mutual contact, the occurrence of electrolytic corrosion due to mutual contact can be suppressed even if the refrigerant flow path unit 10 is supported by the support plate 73 with the mounting plate 72 interposed therebetween.

Thirteenth Embodiments

Figure 17:
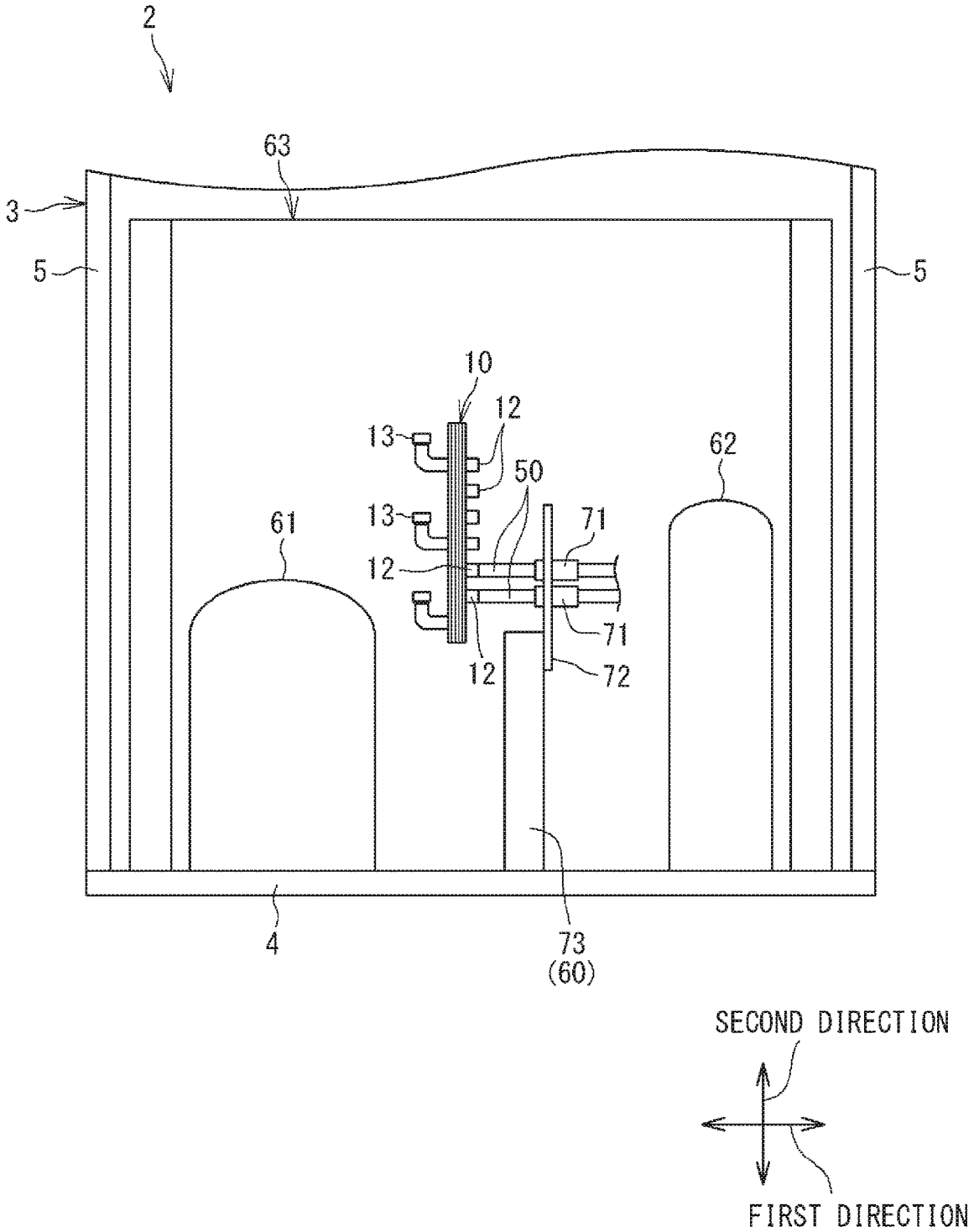
FIG. 17 is a schematic front view of the outdoor unit of an air conditioner according to thirteenth embodiments of the present disclosure.

FIG. 17 is a schematic front view of the outdoor unit 2 of an air conditioner according to thirteenth embodiments of the present disclosure. One or more embodiments are modifications of the twelfth embodiments (see FIG. 16). The refrigerant flow path unit 10 of the outdoor unit 2 according to one or more embodiments is disposed in the standing orientation at a position away from the mounting plate 72 in the first direction.

The predetermined number (two in FIG. 17) of first joint pipes 12 in the refrigerant flow path unit 10 are connected to the refrigerant pipes 50 extending from the shutoff valves 71 that are fixed to the mounting plate 72. Thus, the refrigerant flow path unit 10 is firmly fixed to the support plate 73 with the predetermined number of refrigerant pipes 50, the shutoff valves 71, and the mounting plate 72 interposed therebetween. As described above, the refrigerant flow path unit 10 is supported at a distance above the bottom plate 4 by the fixed-side member 60 (support plate 73) other than the compressor 61.

Each of the shutoff valves 71 is formed from a material that suppresses electrolytic corrosion due to contact with the refrigerant flow path unit 10. The shutoff valve 71 is configured, for example, by insulation paint being applied to the contact portions with the mounting plate 72 and the refrigerant pipe 50. Similarly, the refrigerant pipe 50 extending from the shutoff valve 71 is formed from a material that suppresses electrolytic corrosion due to contact with the refrigerant flow path unit 10. In one or more embodiments, the refrigerant pipe 50 is configured by insulation paint being applied to the contact portions with the shutoff valve 71 and the first joint pipe 12. Other configurations of one or more embodiments are similar to those of the twelfth embodiments, and therefore the description thereof will be omitted.

The air conditioner 1 according to one or more embodiments, similarly to the twelfth embodiments, can suppress the refrigerant flow path unit 10 from being damaged by the operational vibration of the compressor 61. In addition, the occurrence of the ice-up phenomenon can be suppressed.

Since the refrigerant pipes 50, the shutoff valves 71, the mounting plate 72, and the support plate 73 that support the refrigerant flow path unit 10 are existing components, it is not necessary to provide dedicated components to support the refrigerant flow path unit 10. In addition, in the twelfth embodiments, a dedicated fastener for fixing the refrigerant flow path unit 10 to the mounting plate 72 is required, but in one or more embodiments, a dedicated fastener is not required. Thus, the configuration of the outdoor unit 2 can also be simplified.

Since the refrigerant flow path unit 10, the refrigerant pipes 50, the shutoff valves 71, the mounting plate 72, and the support plate 73 are formed from a material that suppresses electrolytic corrosion due to mutual contact, the occurrence of electrolytic corrosion due to mutual contact can be suppressed even if the refrigerant flow path unit 10 is supported by the support plate 73 with the refrigerant pipes 50, the shutoff valves 71, and the mounting plate 72 interposed therebetween.

Fourteenth Embodiments

Figure 18:
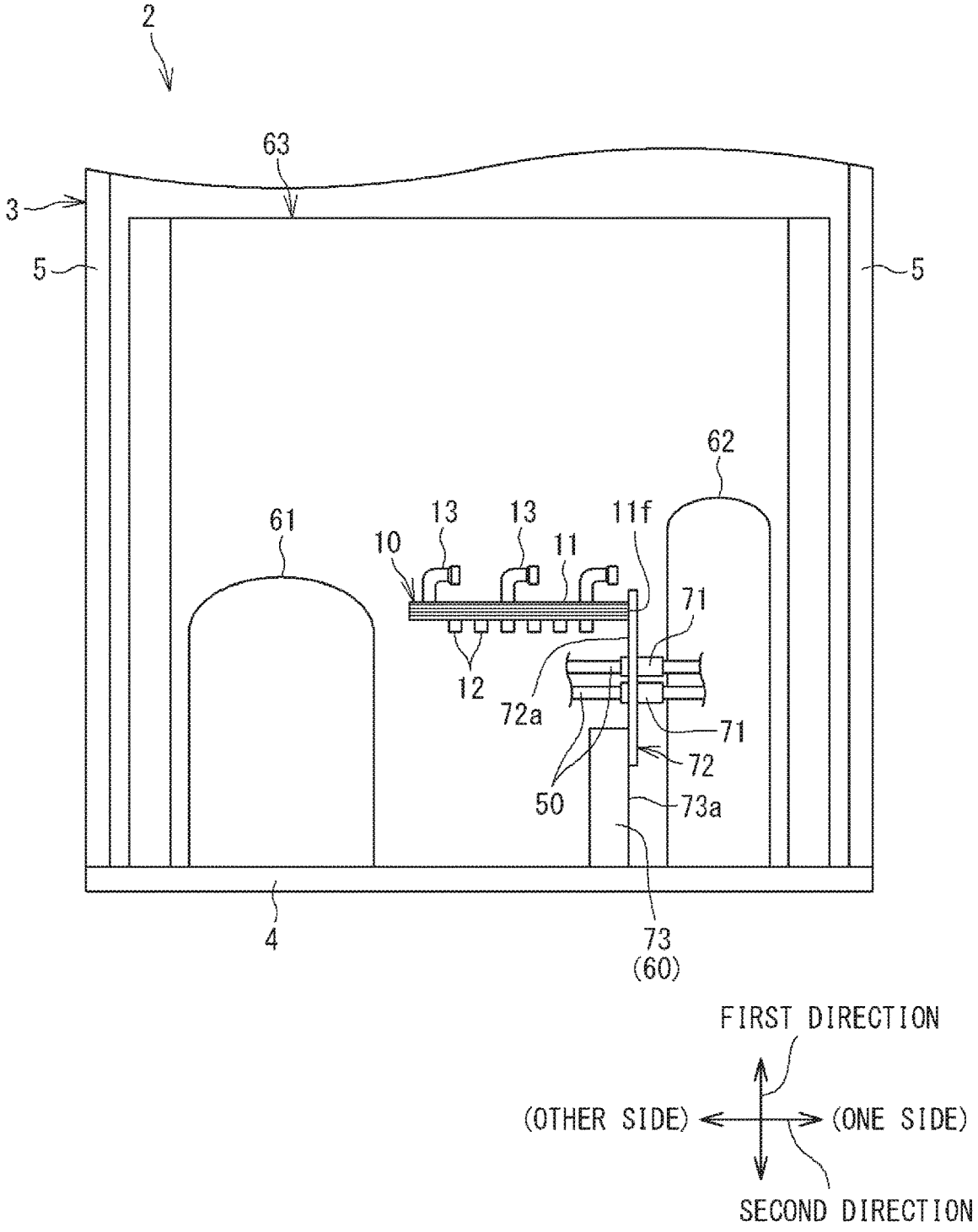
FIG. 18 is a schematic front view of the outdoor unit of an air conditioner according to fourteenth embodiments of the present disclosure.

FIG. 18 is a schematic front view of the outdoor unit 2 of an air conditioner according to fourteenth embodiments of the present disclosure. One or more embodiments are other modifications of the twelfth embodiments (see FIG. 16). The refrigerant flow path unit 10 of the outdoor unit 2 according to one or more embodiments is supported in the lying orientation by the support plate 73 with the mounting plate 72 interposed therebetween. In one or more embodiments, the end surface 11*f* on one side of the unit body 11 in the second direction abuts on the upper portion of the one plate surface 72*a* of the mounting plate 72. In this state, the unit body 11 is firmly fixed to the mounting plate 72 by a fastener (screw or the like) (not illustrated).

As described above, the refrigerant flow path unit 10 is supported at a distance above the bottom plate 4 by the fixed-side member 60 (support plate 73) other than the compressor 61, with the mounting plate 72 interposed therebetween. Other configurations of one or more embodiments are similar to those of the twelfth embodiments, and therefore the description thereof will be omitted. The air conditioner 1 according to one or more embodiments has functional effects similar to the twelfth embodiments.

Fifteenth Embodiments

Figure 19:
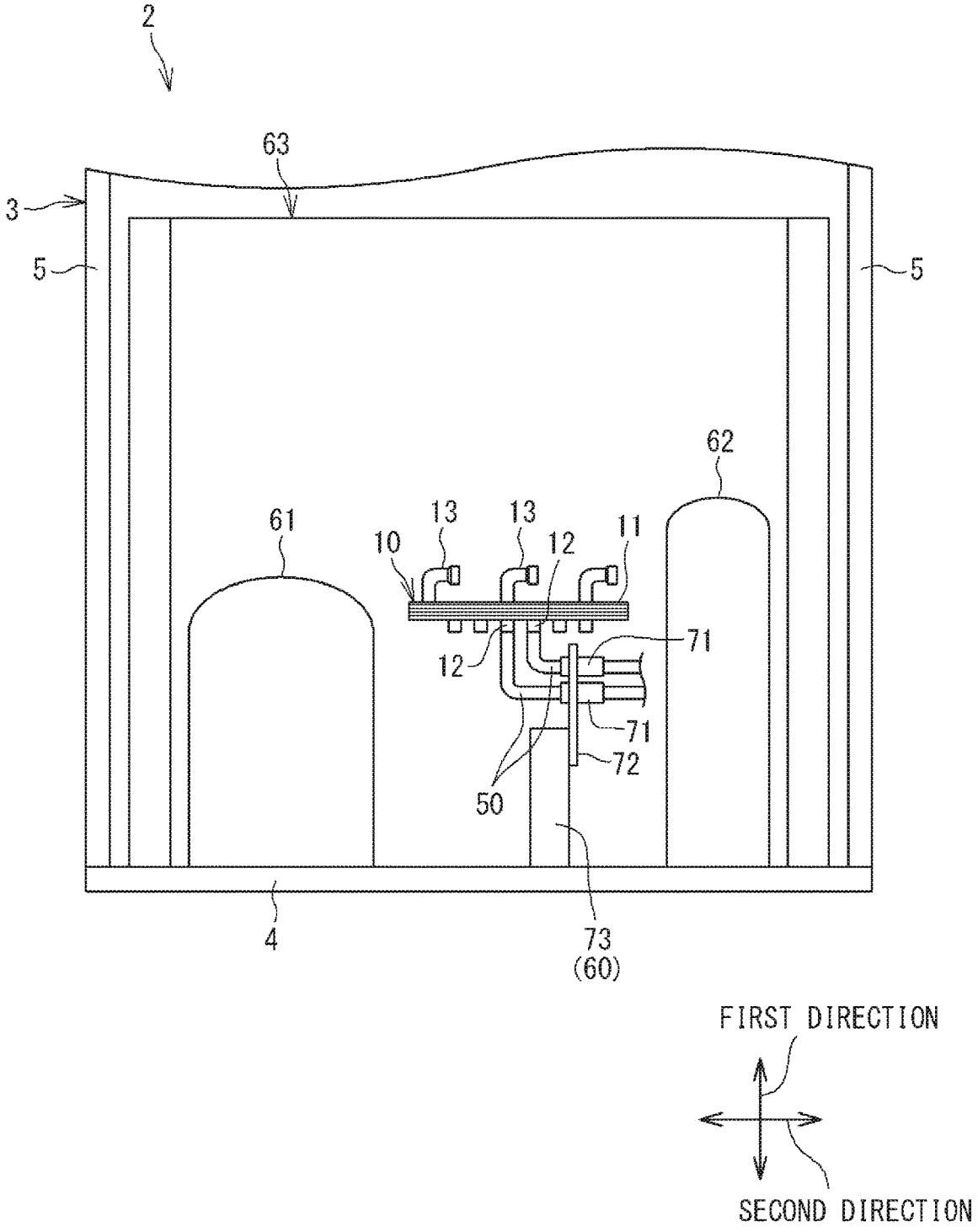
FIG. 19 is a schematic front view of the outdoor unit of an air conditioner according to fifteenth embodiments of the present disclosure.

FIG. 19 is a schematic front view of the outdoor unit 2 of an air conditioner according to fifteenth embodiments of the present disclosure. One or more embodiments are modifications of the thirteenth embodiments (see FIG. 17). The refrigerant flow path unit of the outdoor unit 2 according to one or more embodiments is disposed in the lying orientation at a distance above the mounting plate 72.

The refrigerant flow path unit 10 is disposed with the first joint pipes 12 facing downward. The predetermined number (two in FIG. 19) of first joint pipes 12 in the refrigerant flow path unit 10 are connected to the refrigerant pipes 50 extending from the shutoff valves 71 that are fixed to the mounting plate 72. Thus, the refrigerant flow path unit 10 is firmly fixed to the support plate 73 with the predetermined number of refrigerant pipes 50, the shutoff valves 71, and the mounting plate 72 interposed therebetween.

As described above, the refrigerant flow path unit 10 is supported at a distance above the bottom plate 4 by the fixed-side member 60 (mounting plate 72) other than the compressor 61. Other configurations of one or more embodiments are similar to those of the thirteenth embodiments, and therefore the description thereof will be omitted. The air conditioner 1 according to one or more embodiments has functional effects similar to the thirteenth embodiments.

Others

The air conditioner 1 is not limited to the above embodiments, and may be, for example, an air conditioner dedicated to cooling or a room air conditioner. In the case of a room air conditioner, the refrigerant flow path unit 10 may be suspended from the top panel of the casing of the outdoor unit and supported. The refrigerant flow path unit 10 may be supported by a plurality of the fixed-side members 60 (for example, the side surface of the accumulator 62 and the tube plate 63*b*).

The refrigerant flow path unit 10 is directly supported by the fixed-side member 60, but may be supported by the fixed-side member 60 with a support member, such as a support base, interposed therebetween. In this case, the refrigerant flow path unit 10, the support member, and the fixed-side member 60 may be formed from a material that suppresses electrolytic corrosion due to mutual contact.

In the twelfth to fifteenth embodiments, the mounting plate 72 may be fixed to the upper surface of the bottom plate 4 while directly installed on the upper surface without the support plate 73 interposed therebetween. In this case, the mounting plate 72 serves as the fixed-side member 60 fixed to the casing 3. Therefore, the refrigerant flow path unit 10 is supported by the mounting plate 72, which is the fixed-side member 60 other than the compressor 61, by being directly fixed to the mounting plate 72 or indirectly fixed to the mounting plate 72 with the refrigerant pipe 50 or the like interposed therebetween, as described above.

Although the disclosure has been described with respect to only a limited number of embodiments, those skilled in the art, having benefit of this disclosure, will appreciate that various other embodiments may be devised without departing from the scope of the present disclosure. Accordingly, the scope of the disclosure should be limited only by the attached claims.

REFERENCE SIGNS LIST

1 air conditioner
3 casing
4 bottom plate
7 side plate
8 partition plate
10 refrigerant flow path unit
15 refrigerant flow path
60 fixed-side member
61 compressor
62 accumulator (container)
63 heat exchanger
63*a* heat transfer tube
63*b* tube plate

What is claimed is:

1. An air conditioner comprising:
a casing comprising a bottom plate;
a refrigerant flow path unit that:
is housed inside the casing, and
has an interior in which a refrigerant flow path is formed;
a compressor installed on the bottom plate; and
a refrigerant pipe that is connected to the refrigerant flow path unit, wherein
the refrigerant flow path unit is supported at a distance from the bottom plate by a fixed-side member other than the compressor with the refrigerant pipe that fixes the refrigerant flow path unit to the fixed-side member.

2. The air conditioner according to claim 1, wherein the fixed-side member is an existing component of the air conditioner.

3. The air conditioner according to claim 1, wherein the fixed-side member includes a container that:
is installed on the bottom plate, and
has an interior in which a refrigerant flows.

4. The air conditioner according to claim 3, wherein the refrigerant flow path unit is disposed either:
on an upper surface of the container, or
at a distance above the upper surface.

5. The air conditioner according to claim 1, further comprising:
a heat exchanger comprising:
a heat transfer tube through which a refrigerant flows; and
a tube plate that supports the heat transfer tube, wherein
the fixed-side member includes the tube plate.

6. The air conditioner according to claim 1, wherein the fixed-side member includes either one of:
a side plate of the casing, or
a partition plate that partitions an internal space of the casing.

7. The air conditioner according to claim 2, wherein the fixed-side member includes a container that:
is installed on the bottom plate, and has an interior in which a refrigerant flows.

8. The air conditioner according to claim 2, further comprising:

a heat exchanger comprising:

a heat transfer tube through which a refrigerant flows; and a tube plate that supports the heat transfer tube, wherein the fixed-side member includes the tube plate.

9. The air conditioner according to claim 2, wherein the fixed-side member includes either one of:

a side plate of the casing, or a partition plate that partitions an internal space of the casing.

10. The air conditioner according to claim 1, wherein the refrigerant flow path unit and the fixed-side member are formed from a material that suppresses electrolytic corrosion due to mutual contact.

11. The air conditioner according to claim 2, wherein the refrigerant flow path unit and the fixed-side member are formed from a material that suppresses electrolytic corrosion due to mutual contact.

12. The air conditioner according to claim 3, wherein the refrigerant flow path unit and the fixed-side member are formed from a material that suppresses electrolytic corrosion due to mutual contact.

13. The air conditioner according to claim 4, wherein the refrigerant flow path unit and the fixed-side member are formed from a material that suppresses electrolytic corrosion due to mutual contact.

14. The air conditioner according to claim 5, wherein the refrigerant flow path unit and the fixed-side member are formed from a material that suppresses electrolytic corrosion due to mutual contact.

15. The air conditioner according to claim 6, wherein the refrigerant flow path unit and the fixed-side member are formed from a material that suppresses electrolytic corrosion due to mutual contact.

16. An air conditioner comprising:

a casing comprising a bottom plate;

a refrigerant flow path unit that:

is housed inside the casing, and has an interior in which a refrigerant flow path is formed;

a compressor installed on the bottom plate;

a refrigerant pipe having an end that is connected to the refrigerant flow path unit; and a shutoff valve that opens and closes to allow and block a flow of a refrigerant, the shutoff valve being connected to a portion of the refrigerant pipe leading toward the end, wherein the refrigerant flow path unit is supported at a distance from the bottom plate by a fixed-side member other than the compressor, the fixed-side member comprises either one of:

a mounting plate to which the shutoff valve is fixed, or a support plate to which the mounting plate is fixed, and the refrigerant pipe connects the refrigerant flow path unit with the shutoff valve.

17. An air conditioner comprising:

a casing comprising a bottom plate;

a refrigerant flow path unit that:

is housed inside the casing, and has an interior in which a refrigerant flow path is formed;

a compressor installed on the bottom plate; and a shutoff valve that opens and closes to allow and block a flow of a refrigerant, wherein the refrigerant flow path unit is supported at a distance from the bottom plate by a fixed-side member other than the compressor, the fixed-side member comprises either one of:

a mounting plate to which the shutoff valve is fixed, or a support plate to which the mounting plate is fixed, and the refrigerant flow path unit and the fixed-side member are formed from a material that suppresses electrolytic corrosion due to mutual contact.

* * * * *